US007891199B2

(12) United States Patent
Anthony

(10) Patent No.: US 7,891,199 B2
(45) **Date of Patent: *Feb. 22, 2011**

(54) CRYOGENIC APPARATUS FOR CHILLING BEVERAGES AND FOOD PRODUCTS AND PROCESS OF MANUFACTURING THE SAME

(76) Inventor: Michael Anthony, 10189 W. Sample Rd., Coral Springs, FL (US) 33065

( * ) Notice: Subject to any disclaimer, the term of this patent is extended or adjusted under 35 U.S.C. 154(b) by 772 days.

This patent is subject to a terminal disclaimer.

(21) Appl. No.: 11/895,919

(22) Filed: Aug. 28, 2007

(65) Prior Publication Data

US 2008/0053117 A1 Mar. 6, 2008

Related U.S. Application Data

(63) Continuation-in-part of application No. 11/202,866, filed on Aug. 12, 2005, now Pat. No. 7,260,944.

(51) Int. Cl.
*F25B 45/00* (2006.01)

(52) U.S. Cl. ..... 62/77; 62/125; 62/457.3

(58) Field of Classification Search ..... 62/125, 62/457.3, 457.4, 457.9, 268, 293, 294, 389, 62/77; 220/500, 665; 222/146.6, 399; 426/109, 426/524

See application file for complete search history.

(56) References Cited

U.S. PATENT DOCUMENTS 4,735,348 A * 4/1988 Santoiemmo et al. ..... 222/399
4,881,666 A * 11/1989 Tullman et al. ..... 222/386.5
5,904,267 A * 5/1999 Thompson ..... 220/592.16
5,960,998 A * 10/1999 Brown ..... 222/131
6,216,913 B1 * 4/2001 Bilskie et al. ..... 222/67
6,220,311 B1 * 4/2001 Litto ..... 141/67
6,397,624 B1 * 6/2002 Horwell ..... 62/457.8
7,021,559 B2 * 4/2006 Fraser-Easton ..... 239/302

FOREIGN PATENT DOCUMENTS

WO WO 96/09506 3/1996

* cited by examiner

*Primary Examiner*—Mohammad M Ali
(74) *Attorney, Agent, or Firm*—Mark D. Bowen, Esq.; Malin Haley DiMaggio Bowen & Lhota, P.A.

(57) ABSTRACT

Self-cooling food and beverage containers and processes for manufacturing such containers with cryogenic high-pressure refrigerant cooling apparatus are disclosed. A self-cooling beverage container apparatus containing a beverage or other food product, a method of storing cryogenic gases which then cool said food products, and to methods of assembling and operating the apparatus. A self-cooling beverage container includes a container body having an openable portion, a pressure vessel substantially housed within said container body, the pressure vessel having a first chamber for containing a refrigerant, an actuation valve configurable from a closed configuration wherein the refrigerant is maintained within the pressure vessel to an open configuration wherein said refrigerant is allowed to expand and exit the pressure vessel upon opening of said container whereby refrigerant expansion and flow through said outlet conduit cools the contents of said container.

8 Claims, 40 Drawing Sheets

CRYOGENIC APPARATUS FOR CHILLING BEVERAGES AND FOOD PRODUCTS AND PROCESS OF MANUFACTURING THE SAME

CROSS REFERENCE TO RELATED APPLICATIONS

This application is a continuation-in-part of U.S. patent application Ser. No. 11/202,866, filed on Aug. 12. 2005, now U.S. Pat. No. 7,260,944.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present novel invention relates generally to the field of food and beverage containers and to processes for manufacturing such containers with cryogenic high pressure refrigerant cooling apparatus. More specifically the present invention relates to a self-cooling beverage container apparatus containing a beverage or other food product, a method of storing cryogenic gases which then cool said food products, and to methods of assembling and operating the apparatus. The terms "beverage," "food," "food products" and "container contents" are considered as equivalent for the purposes of this application and used interchangeably. The term "container" refers to any storage means for a beverage or food product.

2. Description of the Prior Art

There have previously been invented many self-cooling apparatus for cooling the contents of a beverage or food container. These apparatus sometimes use flexible and deformable receptacles or rigid receptacle walls to store a refrigerant. The present inventor has invented a variety of such devices and methods of manufacturing these containers. These earlier inventions do not satisfy all the needs of the beverage industry and they do not use cryogenic refrigerants. In fact they are so structurally different from the present invention, that one skilled in the art cannot possibly transcend from the prior art to the present invention, without an inventive process. In an effort to seek a cost effective and functioning apparatus to self-cool a beverage container, the present inventor has done a variety of experiments to arrive at the present novel method. The prior art fails to address the real issues of manufacturing and beverage plant operations that are crucial for the success of a self-cooling beverage container program. All prior art designs fail to show how to incorporate high pressure gases and effectively release them without danger. The problem stems from the extreme high pressure of the suitable cryogenic gases such as carbon dioxide or $CO_2$. Many trials and designs have been done to obtain the present configuration of the disclosed receptacle of this invention. No prior art teaches how to manufacture a self-cooling beverage plastic bottle as a simple integrated and manufacturable unit that will conform to the standards of the beverage industry.

For example prior art teaches how to make high pressure containers made from steel or small diameter tubing. Since such receptacles are generally made from thick-walled metallic materials for containing high pressure, rapid heat transfer is limited and almost impossible. Even with prior designs of co-seamed internal receptacles such as that described in U.S. Pat. No. 6,065,300 to the present inventor the problem was still not solved. Also, the high speed beverage plants require high speed compatible operations for manufacture of an online self-cooling beverage container. For example, prior art designs do not address easy insertion, self-aligning of the receptacle with the container and so on, particularly when the container is a plastic bottle. Further, most prior art relies on a separate un-integrated manufacturing process for the attachment of the receptacle to the container. The prior art differs from the current disclosed invention in that they all require complicated valving for activation of the cooling process. Most use complicated gaskets and expensive attachment means. The present invention does not require a special valving system. Just a few parts that form the receptacle and the attachment means to the bottle suffice to form a self-acting valve based on the opening of the container for consumption.

This invention is an improvement over prior art and discloses a novel technology for bottles and cans (metal containers) also with the additional aspect of using cryogenic propellant mixtures such as carbon dioxide. The reason for the improvement is that no other technology addresses the high pressure container costs associated with the manufacture of metal containers.

SUMMARY OF THE INVENTION

The present invention accomplishes the above-stated objectives, as well as others, as may be determined by a fair reading and interpretation of the entire specification. For the preferred of several possible embodiments, the apparatus includes a modified conventional beverage or food container such as a plastic bottle or a metal can for containing a product to be consumed. In the first embodiment, the bottle container is an injection-stretch-blown plastic bottle with a conventional unified bottom wall and a cylindrical side wall terminating in a wide threaded open bottle neck. The bottle is cut into two separate parts that can then be thermally sealed together using the refrigerant canister assembly of the present invention. The bottle is laser or knife cut into a top bottle member and a bottom bottle member. The top bottle member consists of an open threaded neck sealingly and contiguously connected to a top bottle member cylindrical wall terminating on a uniform circular bottle cut edge. The bottle bottom member consists of a bottle base dome and walls that are contiguously connected to a series of base protrusions that form a stand for the bottle. The bottle base dome has a central bottle base dome hole. The base protrusions connect contiguously as a unified wall to a bottle base member cylindrical wall that terminates on a uniform circular bottle cut edge.

A specially designed high pressure refrigerant receptacle assembly comprises of a cylindrical canister member sealing threaded unto a canister cap member. The canister member can be made from a suitable food grade plastic such as glass reinforced polyethylene-teraphthalate (PET) or pure PET. It could also be casted from aluminum of suitable grade. The canister member has contiguously cylindrical wall with a sealed canister base and an open canister threaded neck. The canister member has a through concentric canister central support tube member that fluidly connects the inside of the canister member to the canister top outer surface. The canister central support tube has a closed-off end at the canister open threaded neck end and an open end at the canister base. Further, several thin-walled canister webs connect the canister central support tube member to the inside canister cylindrical wall, so that the canister member is structurally supported against lateral and hoop stresses due to high pressure forces. A small central cylindrical cut on of material is removed from these canister webs to form a rubber sleeve seat for a cylindrical rubber sleeve to seat.

Further, the canister outer wall has canister hoop support bands for supporting hoop stresses. The canister member also has a canister top cylinder that protrudes from its canister top surface. The canister top cylinder is open ended terminating at a canister top cylinder edge. A small refrigerant port passes through the canister base, off-set from the center of the canister member and terminates at either end on a canister outer seal seat and a canister inner seal seat respectively so that there is fluid communication between the inside of the canister member and the outside of the canister member to form a refrigerant port for the receptacle assembly. The canister outer seal seat and the canister inside seal seat are preferably tapered but could be any shape depending on whether a ball valve or a different topology seal is used on either seal.

The canister cap member is essentially a cylindrical unit with an open canister cap threaded-end that sealingly mates to the canister member open threaded neck to form a sealed refrigerant receptacle. The canister cap member has a sealing ring member attached to the main canister cap body by a series of small sealing ring support members. The outer surface of the sealing ring member fits slidingly inside the bottom bottle member inner cylindrical wall surface. A central cylindrical canister cap stud protrudes centrally from the outer surface of the canister cap member. A small canister cap stud hole passes through the canister cap stud to make fluid communication between the inside and the outside of the canister cap member. A central cylindrical canister cap sealing sleeve protrudes centrally inside the canister cap member, so that the canister cap stud hole breaks into it. This canister cap sealing sleeve member fits loosely and concentrically around the open end of the canister central tube member and acts as a refrigerant passage way through the assembled receptacle when needed.

Before the canister member and the canister are sealingly mated, a small inner rubber seal member is inserted to seat on the canister inner seal seat. A cylindrical rubber sleeve is also inserted around the canister cap sealing sleeve. The canister cap member is threaded unto the canister member and the cylindrical rubber sleeve forms a seal between the canister cap sealing sleeve and the canister central support tube. The rubber sleeve seat on the canister webs act as a support seat for the rubber sleeve. Thus, advantageously, the refrigerant passageway formed by the canister central support tube and the canister cap sealing sleeve is not yet in fluid communication with the inside of the canister member. A continuous refrigerant passageway can thus be created right through the assembled receptacle unit by simply puncturing this seal. Advantageously before sealing the canister member and the canister cap member, refrigerant in the form of dry-ice or a liquefied cryogen may then be filled into the canister member before sealing with the canister cap member. This has the advantage of easy charging and handling of the high pressure refrigerant. Alternatively, the unit could be charged with liquefied refrigerant mixtures through the canister cap stud member hole by pumping refrigerant through the rubber sleeve which then acts as a one-way-valve for the refrigerant to enter the receptacle, but not leave the receptacle. Since, the canister central support tube member is closed-off at the enclosed end within the receptacle, no refrigerant will pass through the refrigerant passageway during liquid phase charging. In either case, the inner rubber seal member will seal off the refrigerant port by means of pressure holding it in place against the canister inner seal seat so that no refrigerant can escape from the receptacle assembly.

An actuation cap member is designed to be slidingly placed over the canister top cylinder member to act as part of an actuation valve system for the unit. The actuation cap member is a cup shaped member with an open-ended cylindrical wall contiguously connected to a top wall.

An actuation cap protruding stud member protrudes from the inner bottom surface of the actuation cap member. A protruding actuation pin projects centrally from the actuation stud member to form an actuation pin. The top concentric surface of the actuation cap protruding stud member, acts as an actuation cap seal seat for the outer rubber seal member. Before assembling the actuation cap with the assembled receptacle unit, the outer rubber seal is placed by piercing it through the actuation pin and seating said outer rubber seal on the actuation cap seal seat. In case an o-ring is used, no piercing is needed, since the actuation pin can easily passed over the o-ring hole.

The actuation cap member is slidingly fitted over the canister top cylinder, to form a sealed actuation chamber. At the same time, the actuation pin is also inserted into the refrigerant pin to fit snugly inside it and the outer rubber seal is made to just contact the canister outer seal seat. The outer rubber seal is compressible, but during assembly it is not in a compressed state but just makes contact with the actuation cap seal seat and the canister outer seal seat. The actuation pin just contacts the inner rubber seal.

In the first embodiment for bottles, the receptacle assembly is then inserted into the open bottom bottle member so that the sealing ring member fits slidingly inside the bottom bottle member inner cylindrical wall surface and the canister cap stud projects sealingly through a bottom base dome hole. The sealing ring member top edge should be at least an eighth of an inch or so below the bottle cut edge. Heat is applied to the bottle base outer cylindrical shrink surface just around the region where the sealing ring member is located while the subassembly is spun. The bottle base shrink inner and outer walls shrink rapidly so that the shrink inner surface clamps sealingly unto the seal ring by compression. The bottle cut edge of the bottle base member forms a heat-shrunk bottle base sealing curl around the canister cap sealing ring member. The bottle top member is then placed so that it bottle cut edge lies approximately an eighth of an inch below the canister cap sealing ring member. Heat is applied while the bottle top member heat shrink outer surface, while the bottle subassembly is spun. Since the material the bottle is made from is an injection stretch-blown material, it will tend to shrink when heat is applied to its enlarged expanded blown diameter. The bottle top shrink inner and outer walls shrink rapidly so that the shrink inner surface clamps sealingly unto the seal ring by compression. The bottle top member cylindrical edge then also forms a bottle top sealing curl over the bottom of the canister cap member sealing ring member.

This way, the receptacle assembly is sealing attached to the bottle top member and the bottle bottom member forming a contiguously sealed beverage bottle.

The completed bottle assembly is similar in shape and size to conventional plastic beverage bottles, but with the receptacle assembled within it.

The original bottle is preferably made from a suitable plastic material such as Polyethylene-Teraphthalate, (PET) that can be injection-stretch-blown, so that it is a heat shrinkable material. However, it could also be injection molded and put together using a shrink sleeve band. Thus, the assembly can handle a tremendous amount of pressure stresses.

The high pressure receptacle is designed to store high pressure liquefied cryogenic gases, such as carbon-dioxide, mixtures of aerosol propellants and carbon-dioxide, or a matrix held aerosol propellants with smell ingredients such as a combination of $CO_2$ and carbon atoms. The refrigerant used for the cooling process may be designed as a slurry of an activated carbon matrix with $CO_2$ gas trapped inside the matrix.

The apparatus further comprises a conventional bottle cap for sealing off the beverage products after being filled.

The bottle assembly is then filled with carbonated product and then the bottle cap fitted to bottle top member open threaded end to seal off the product. The finished apparatus is then stored for later use or sale. During storage, carbonation pressure slowly compresses the actuation cap member because the sealed actuation chamber formed between the actuation cap member and the canister top cylinder is at atmospheric pressure due to the refrigerant passageway through the receptacle and through the canister cap stud hole. As carbonation pressure builds up, the actuation cap member slowly compresses the outer rubber seal forming a hermetic seal with the canister outer seal seat. Since the actuation cap member experiences a lot more force from carbonation pressure due to its larger surface area than the canister inner seal experiences from the refrigerant pressure, it compresses the outer rubber seal and forms a better seal between the outer rubber seal and the canister outer seal seat, so that slight leaks between the canister inner seal seat and the inner rubber seal will progressively make the inner rubber seal lose its effective pressure differential with the atmosphere and then it will fall away from the canister inner seal seat and drop to the bottom of the receptacle assembly by gravity. Since it will be deformed by the original acting pressure force of the refrigerant, it will not readily form a seal within the receptacle if it should again come into contact with the canister inner seal seat.

When a consumer opens the beverage bottle, carbon pressure is released and the actuation cap member loses its holding force against the outer rubber seal. The outer rubber seal is pushed away from the canister outer seal seat and the refrigerant escapes from the receptacle into the actuation chamber. The actuation cap member is pushed upward slightly by pressure and the refrigerant is free to evaporate and remove heat from the beverage by expanding to the atmosphere through the refrigerant passage way at the center of the canister central support tube.

In the case of a metal container, a cylindrical can is provided with a unified bottom dome and a top in the manner of a classic beverage container. A hole is made through the center of the dome to snugly hold the canister cap central stud member. The canister cap domed outer surface is designed to smoothly match the diameter and shape of the dome of the container. A Food and Drug Administration approved glue could be used to bond the receptacle to the container dome, but in general, the snug fitting of the canister cap stud and the container dome hole is enough, since after assembly, pressure from the carbonated product will firmly hold the canister cap domed outer surface to the container dome. After assembly, the container is filled with carbonated beverage and then sealed off with a conventional lid with an opening means.

The finished apparatus is then stored for later use or sale. During storage, carbonation pressure slowly compresses the actuation cap member because the sealed actuation chamber formed between the actuation cap member and the canister top cylinder is at atmospheric pressure due to the refrigerant passageway through the receptacle and through the canister cap stud hole. As carbonation pressure builds up, the actuation cap member slowly compresses the outer rubber seal forming a hermetic seal with the canister outer seal seat. Since the actuation cap member experiences a lot more force from carbonation pressure due to its larger surface area than the canister inner seal experiences from the refrigerant pressure, it compresses the outer rubber seal and forms a better seal between the outer rubber seal and the canister outer seal seat, so that slight leaks between the canister inner seal seat and the inner rubber seal will progressively make the inner rubber seal loose its effective pressure differential with the atmosphere and then it will fall away from the canister inner seal seat and drop to the bottom of the receptacle assembly by gravity. Since it will be deformed by the original acting pressure force of the refrigerant, it will not readily form a seal within the receptacle if it should again come into contact with the canister inner seal seat.

Again, as in the previous embodiment, when a consumer opens the beverage container by using the container opening means, carbon pressure is released from the container and the actuation cap member looses its holding force against the outer rubber seal. The outer rubber seal is pushed away from the canister outer seal seat and the refrigerant escapes from the receptacle into the actuation chamber. The actuation cap member is pushed upward slightly by pressure and the refrigerant is free to evaporate and remove heat from the beverage by expanding to the atmosphere through the refrigerant passage way at the center of the canister central support tube.

A self-cooling container apparatus is further provided for retaining container contents such as food or beverages; and a container contents release mechanism for releasing the container contents from the container and also for effectuating the release of liquefied gas stored in a high pressure receptacle.

It is an objective of this invention to disclose a novel high pressure receptacle for storing cryogenic fluids for use in self-cooling beverage containers.

It is an objective of this disclosure to reveal a novel method of activating a high pressure receptacle using carbonation pressure.

It is a further objective of this disclosure to reveal a method of assembling a high pressure cryogenic receptacle into a plastic beverage bottle with a conventional neck finish and into a metal can with a conventional lid without the need for expensive threaded parts.

It is a further objective of this invention to disclose a novel method of coupling two parts of a plastic bottle to form a contiguous container by means of heat shrinking surfaces said two parts over a sealing ring.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE INVENTION

Figure 1:
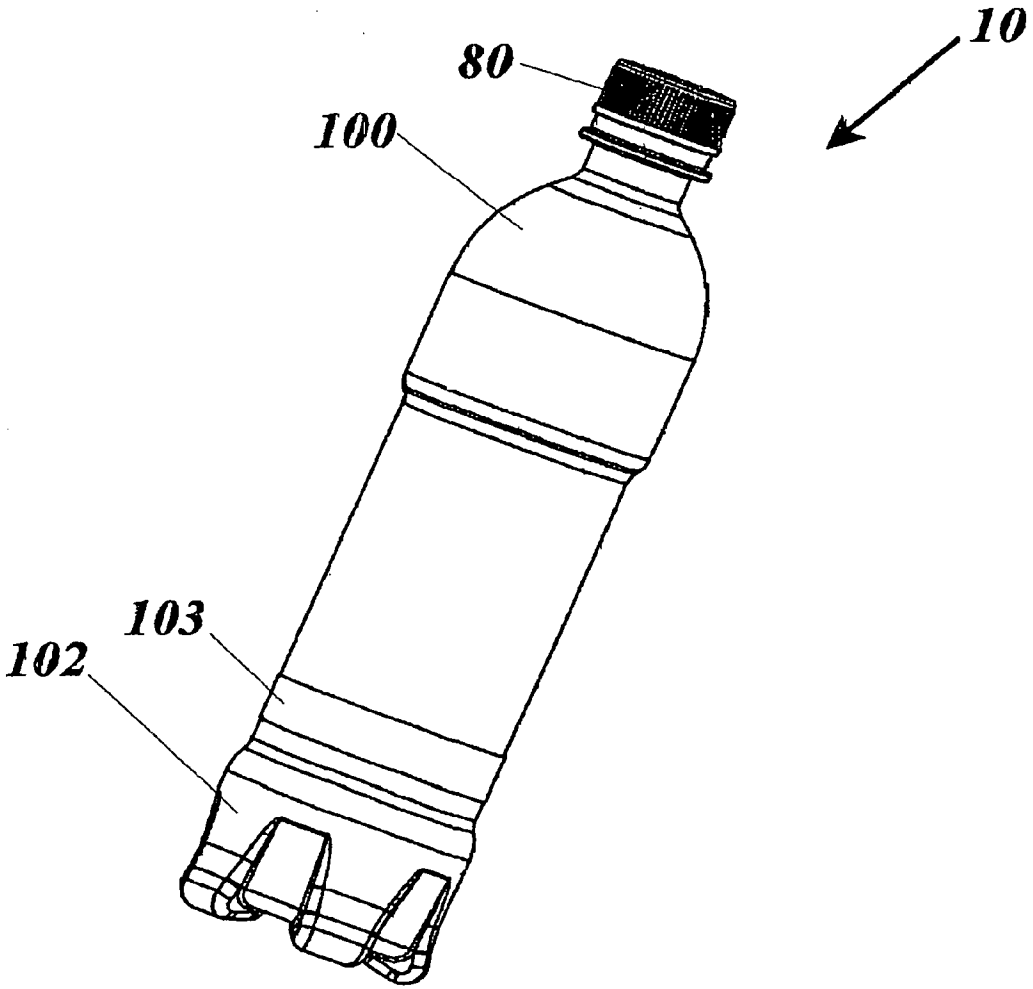
FIG. 1 shows the beverage container assembly according to the preferred embodiment of this invention.
Figure 2:
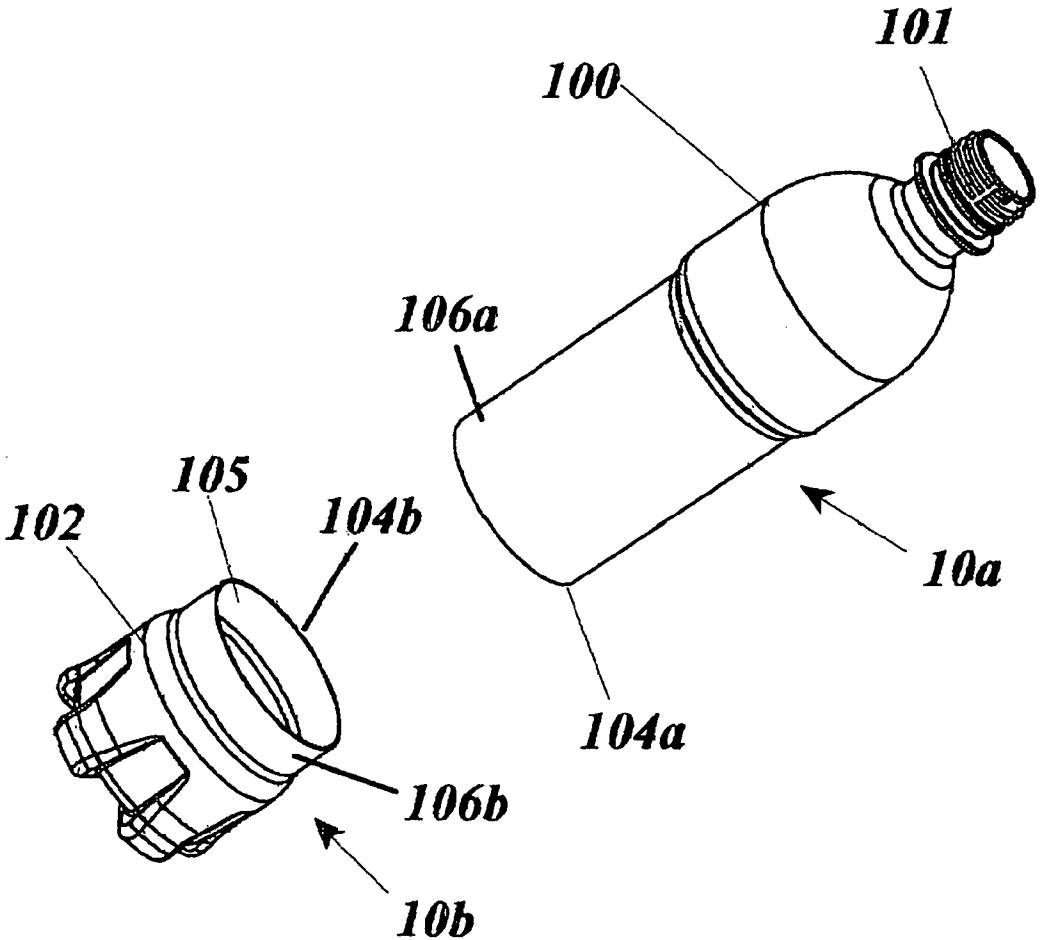
FIG. 2 shows the beverage container assembly according to the preferred embodiment of this invention with a special time release cap opened.
Figure 3:
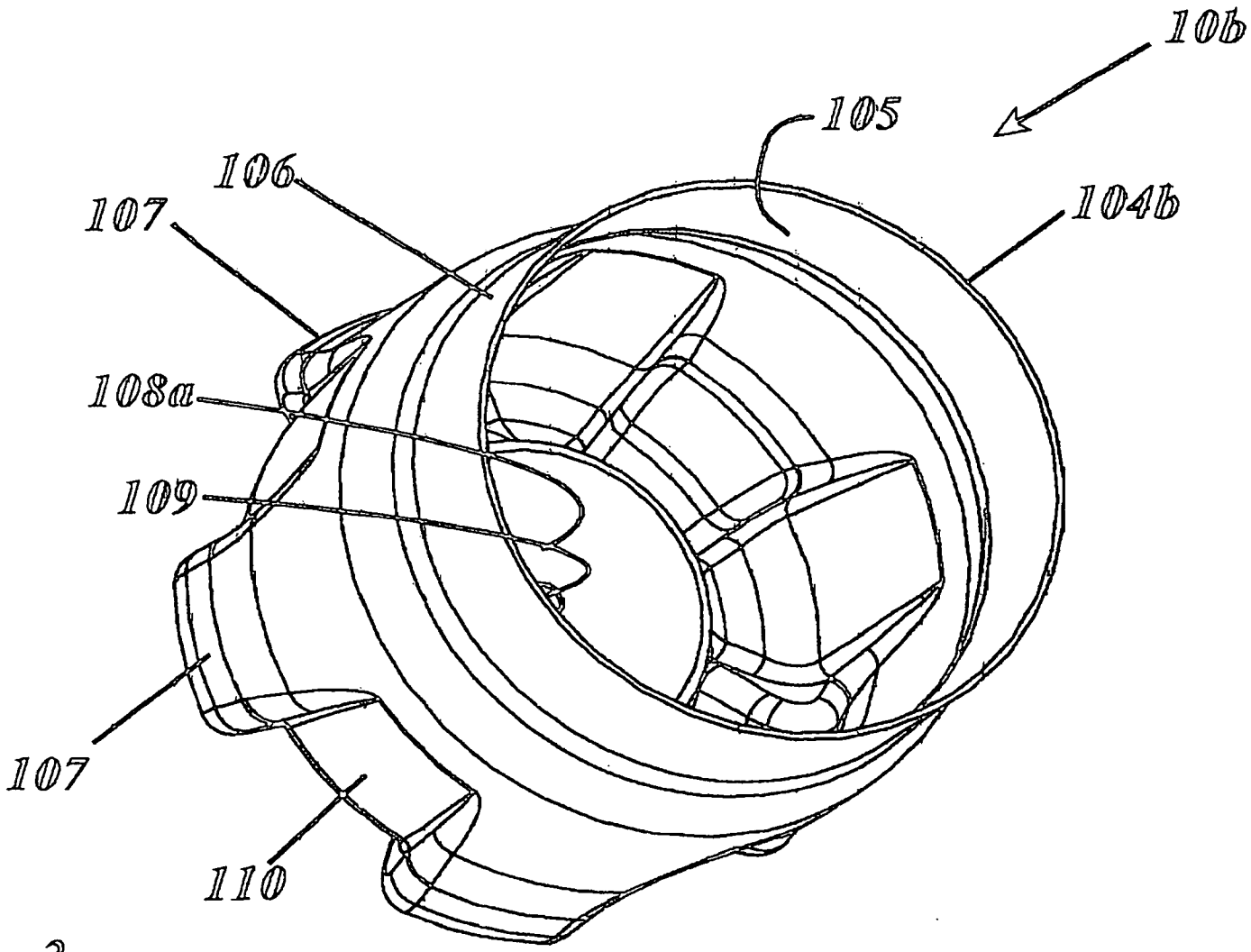
FIG. 3 shows the beverage container assembly according to the preferred embodiment of this invention with the bottle separated from the bottle cap, and the time release cap.
Figure 4:
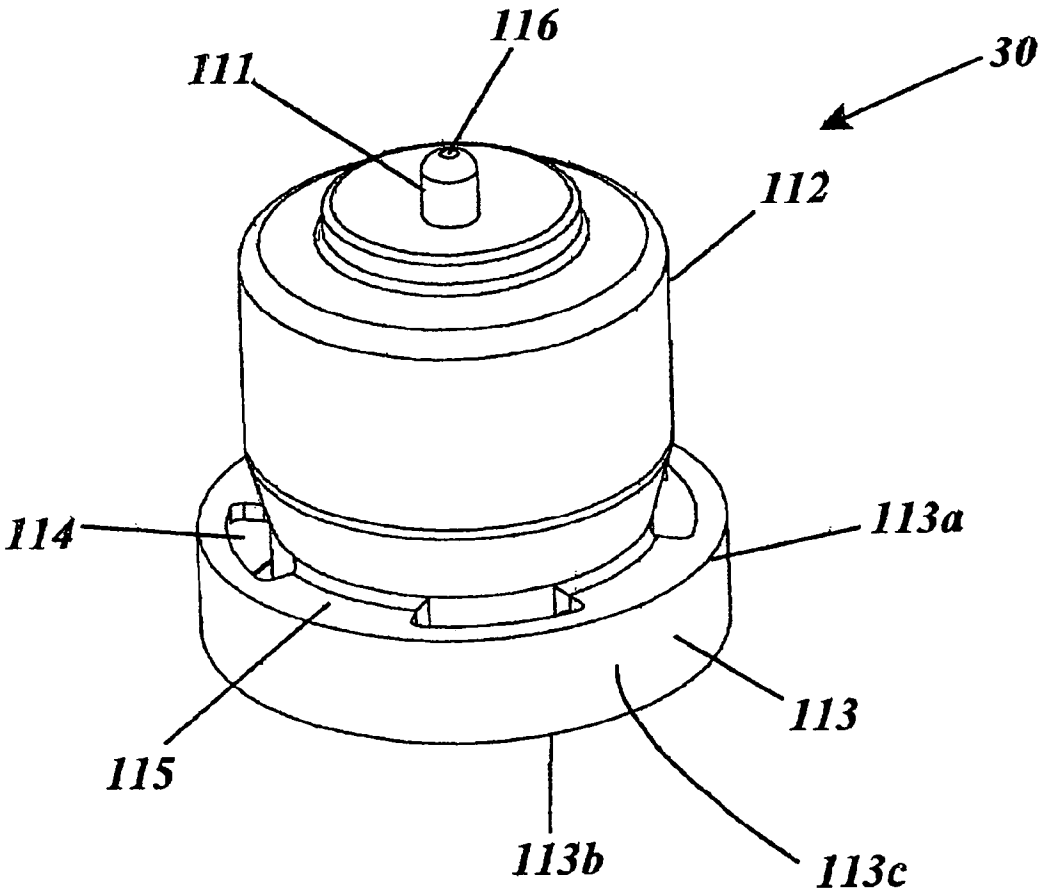
FIG. 4 shows the high pressure receptacle assembly with the sleeve and high pressure receptacle, held to the grove of the bottle cap by the actuation cap.
Figure 5:
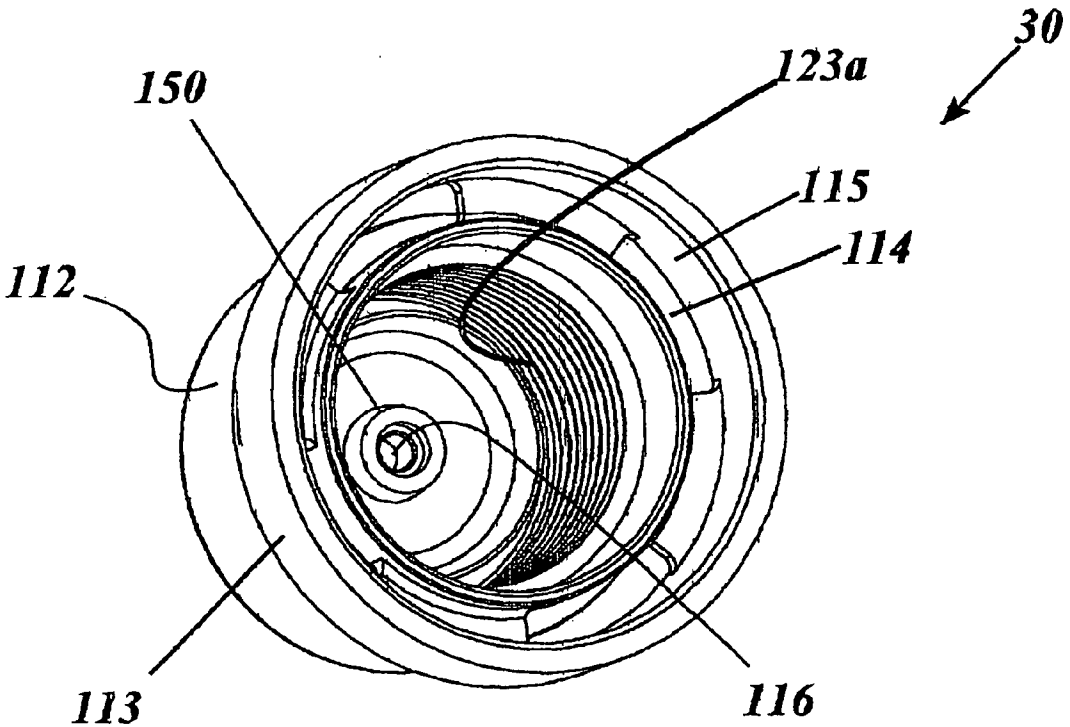
FIG. 5 shows some details of the canister cap member.
Figure 6:
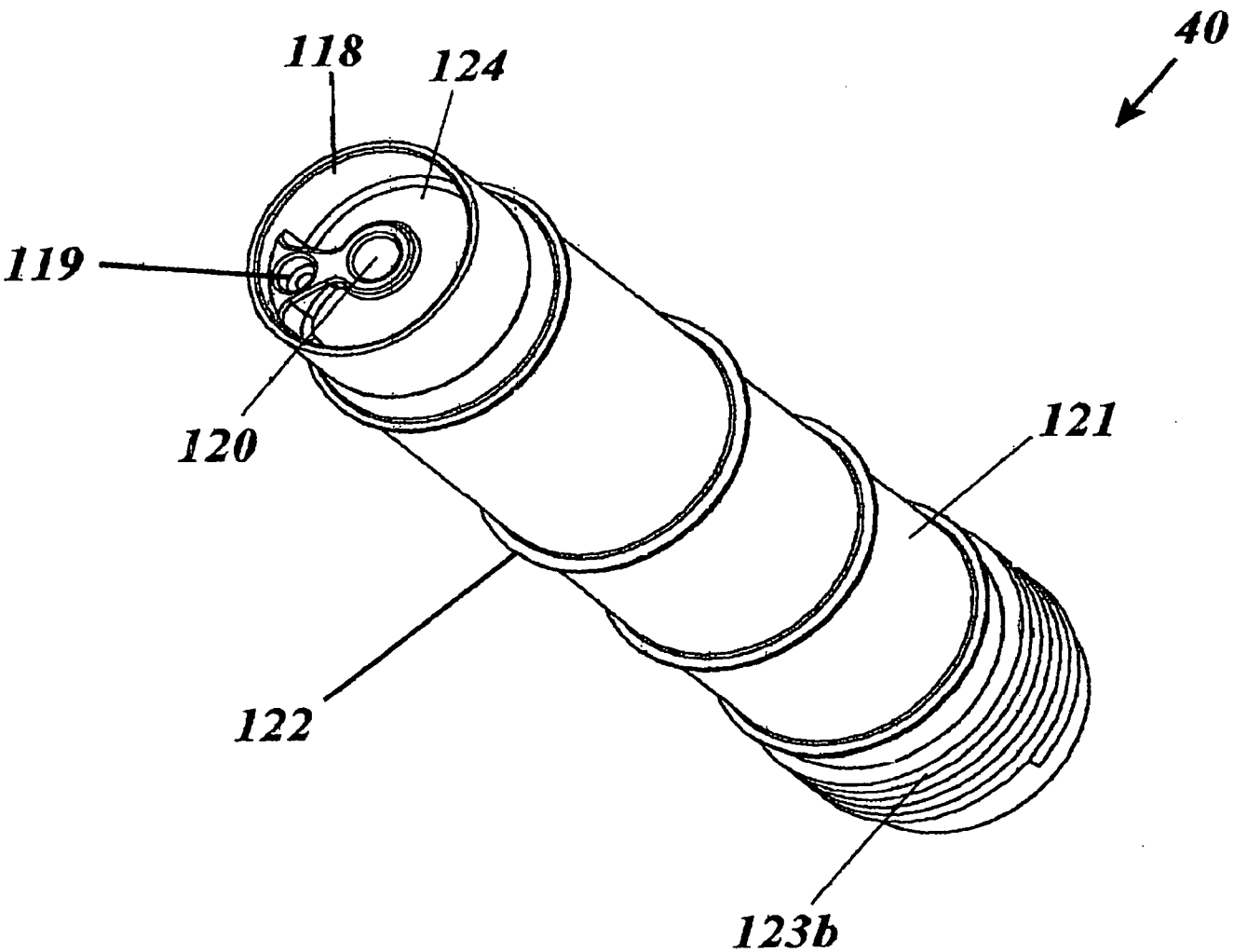
FIG. 6 shows the canister of the present invention.
Figure 7:
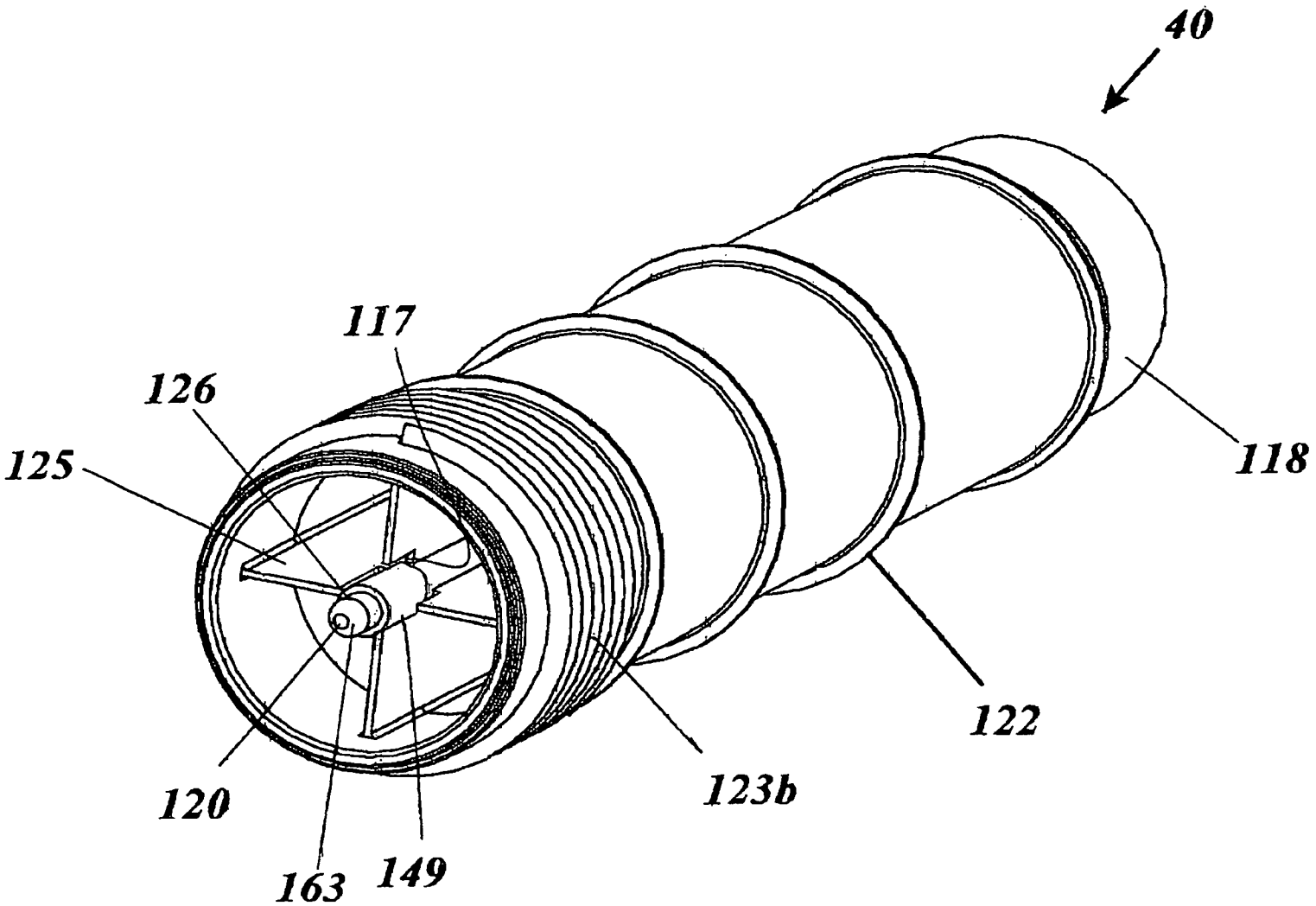
FIG. 7 shows details of the canister of the present invention.
Figure 8:
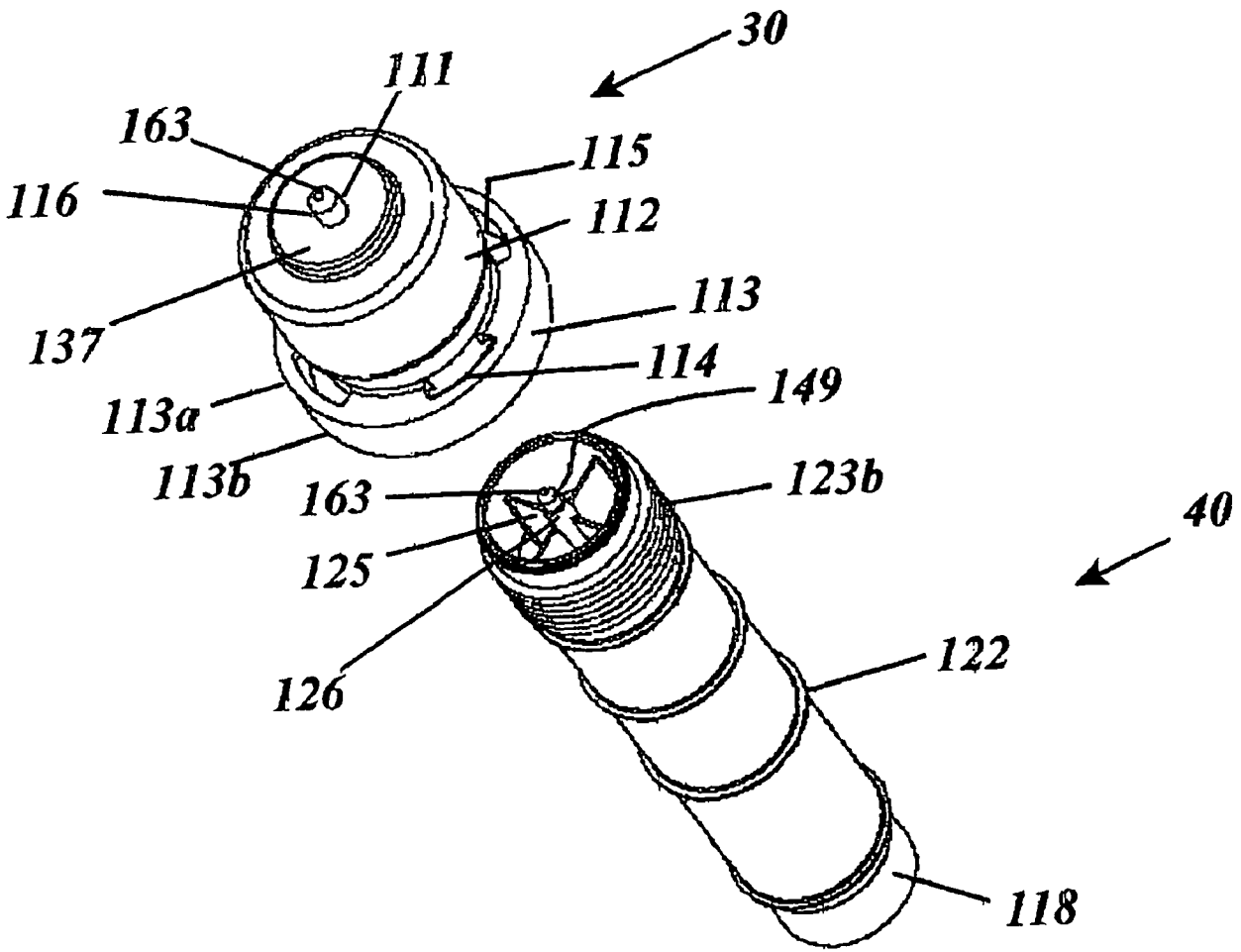
FIG. 8 shows the canister and the canister cap in an assembly posture.
Figure 9:
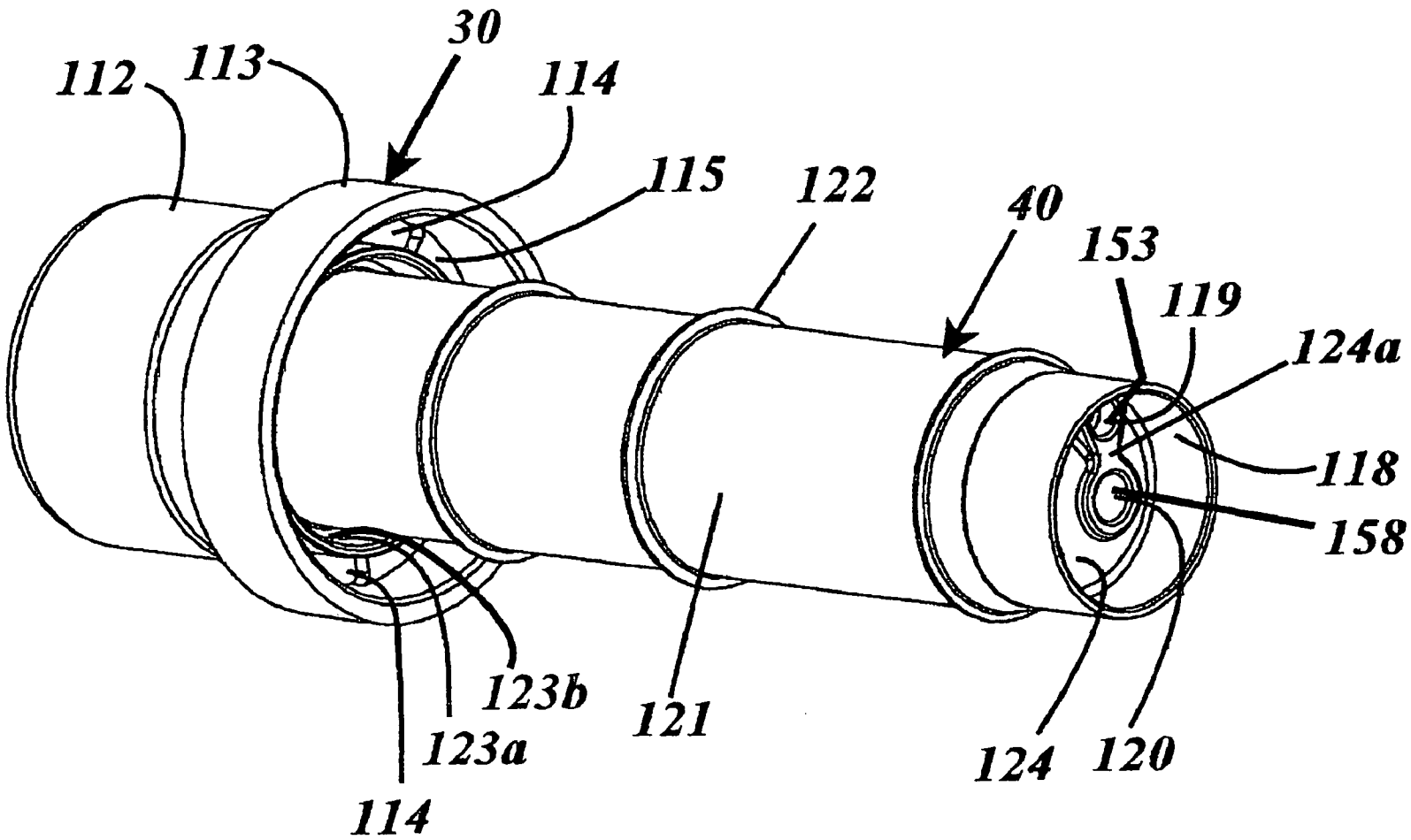
FIG. 9 shows the high pressure receptacle assembly.
Figure 10:
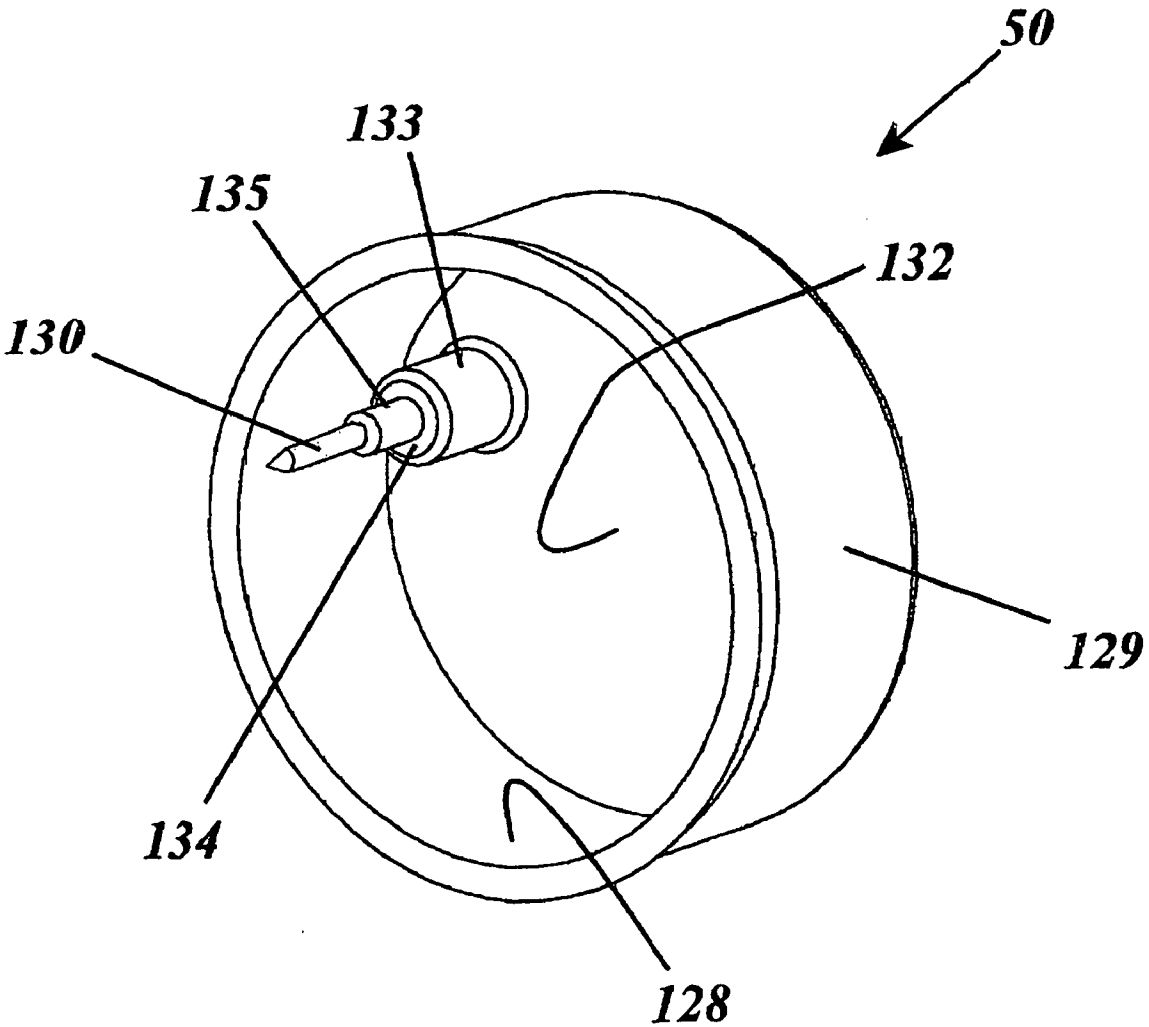
FIG. 10 shows the actuation cap and the actuator pin.
Figure 11:
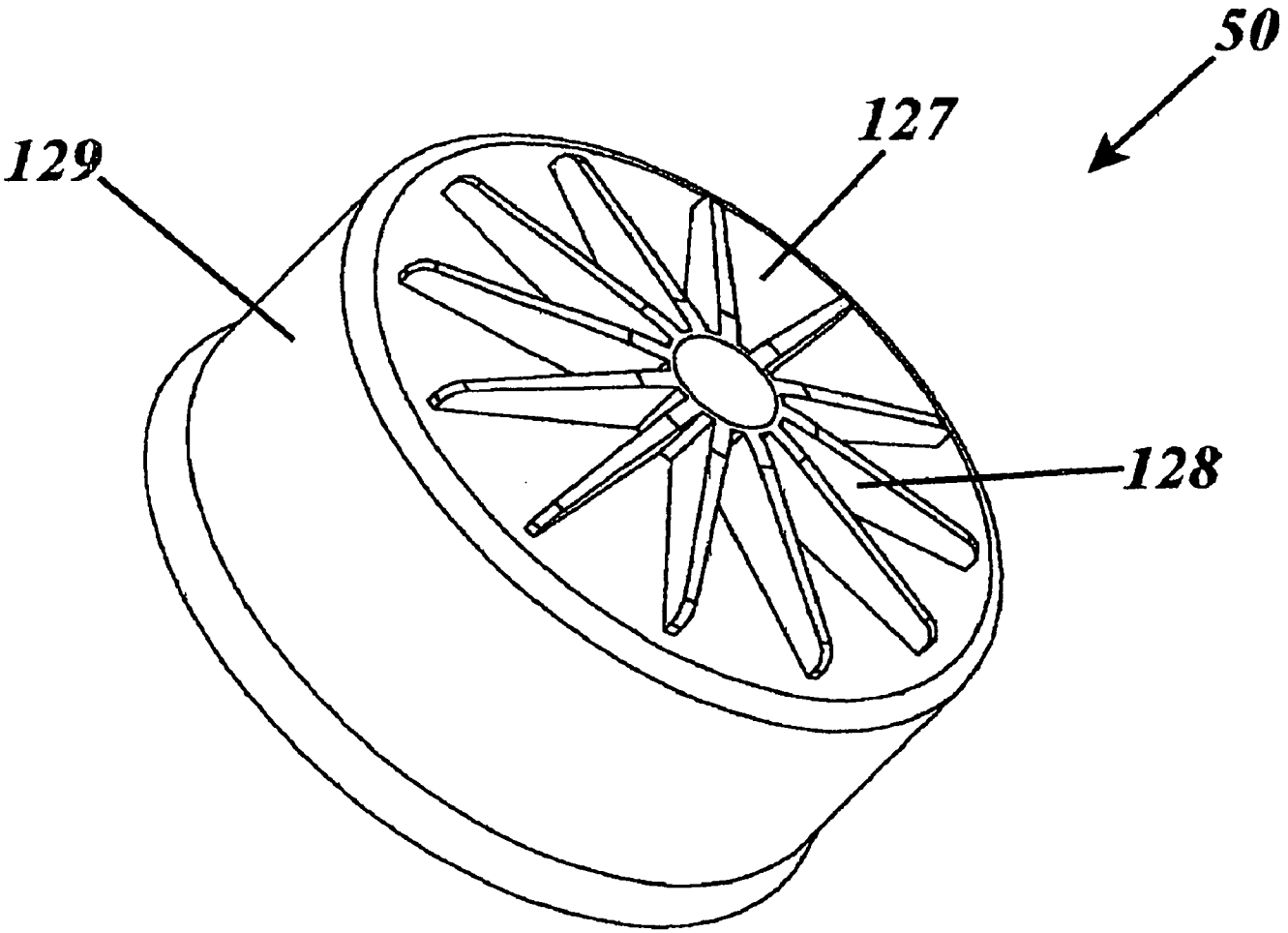
FIG. 11 shows the actuation cap and its external structure.
Figure 12:
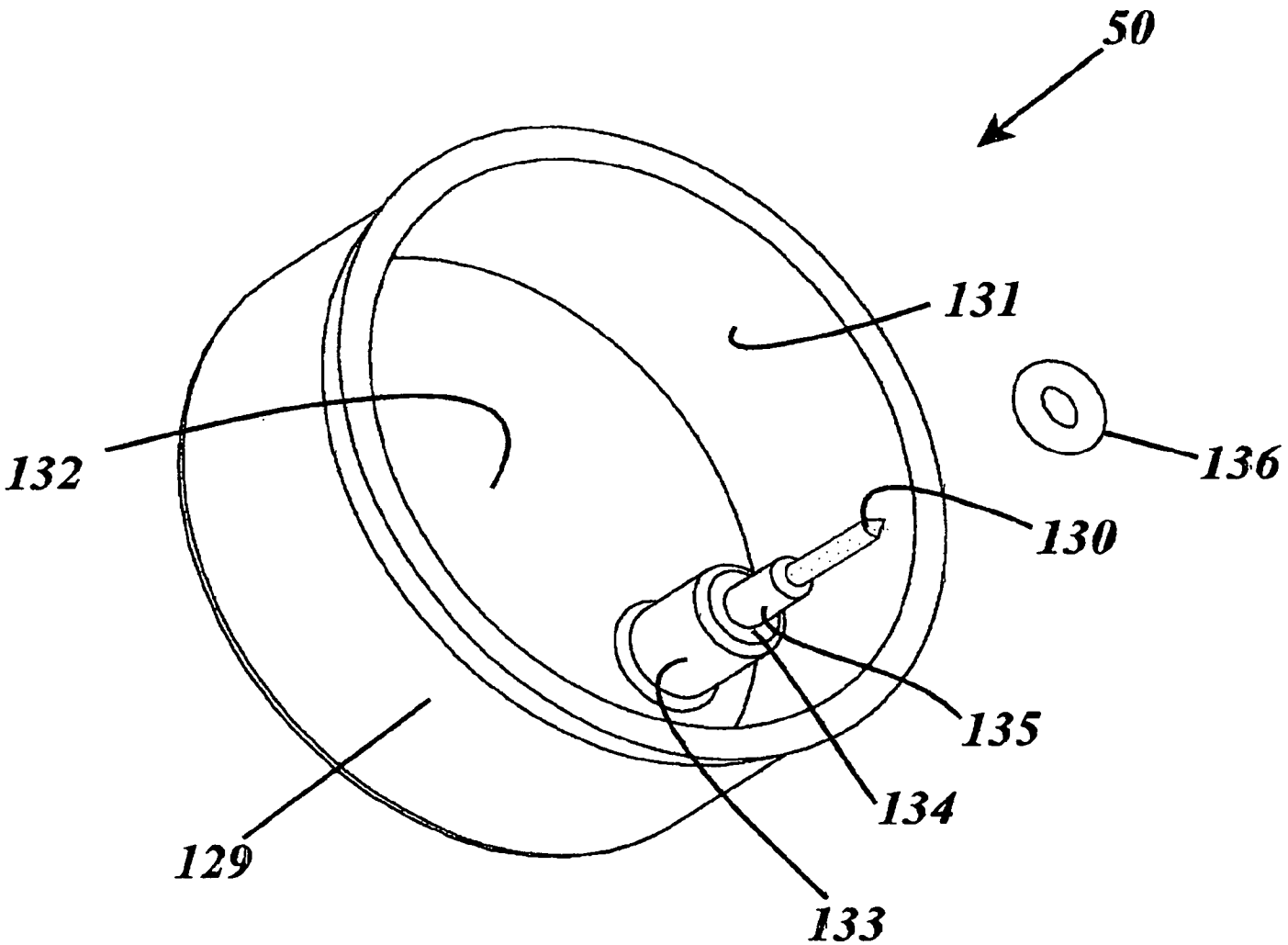
FIG. 12 shows the actuation cap and its internal structure with the canister outer seal being positioned.
Figure 13:
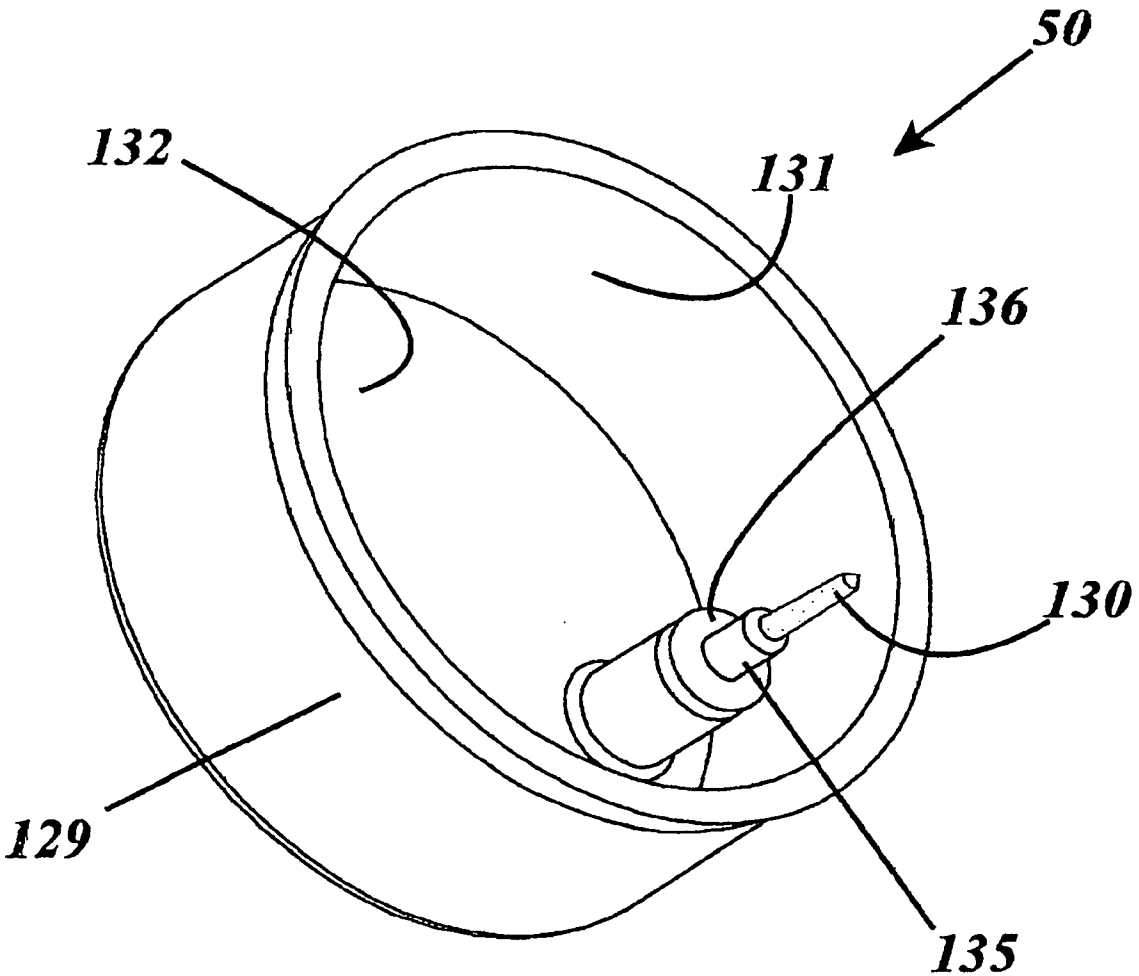
FIG. 13 shows the actuation cap and the canister outer seal assembled.
Figure 14:
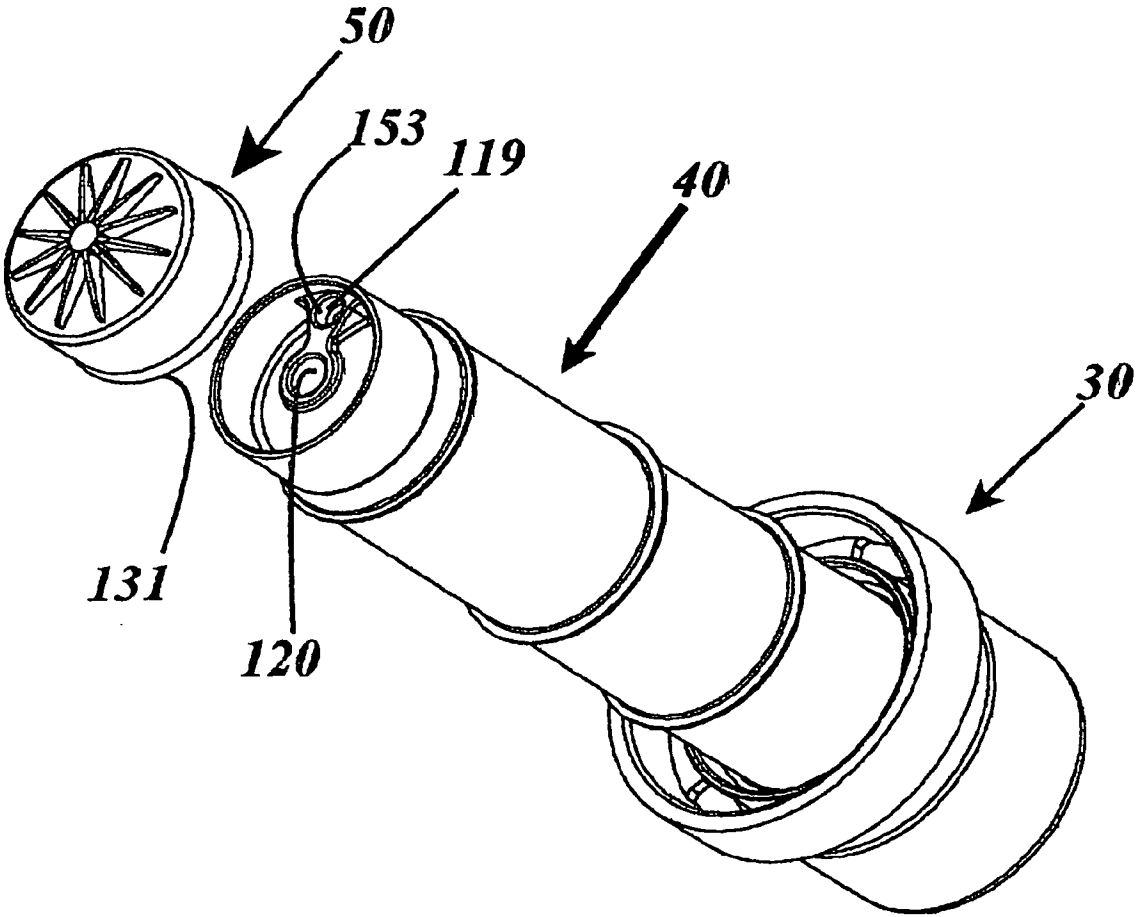
FIG. 14 shows the actuation cap member being assembled unto the receptacle assembly.
Figure 15:
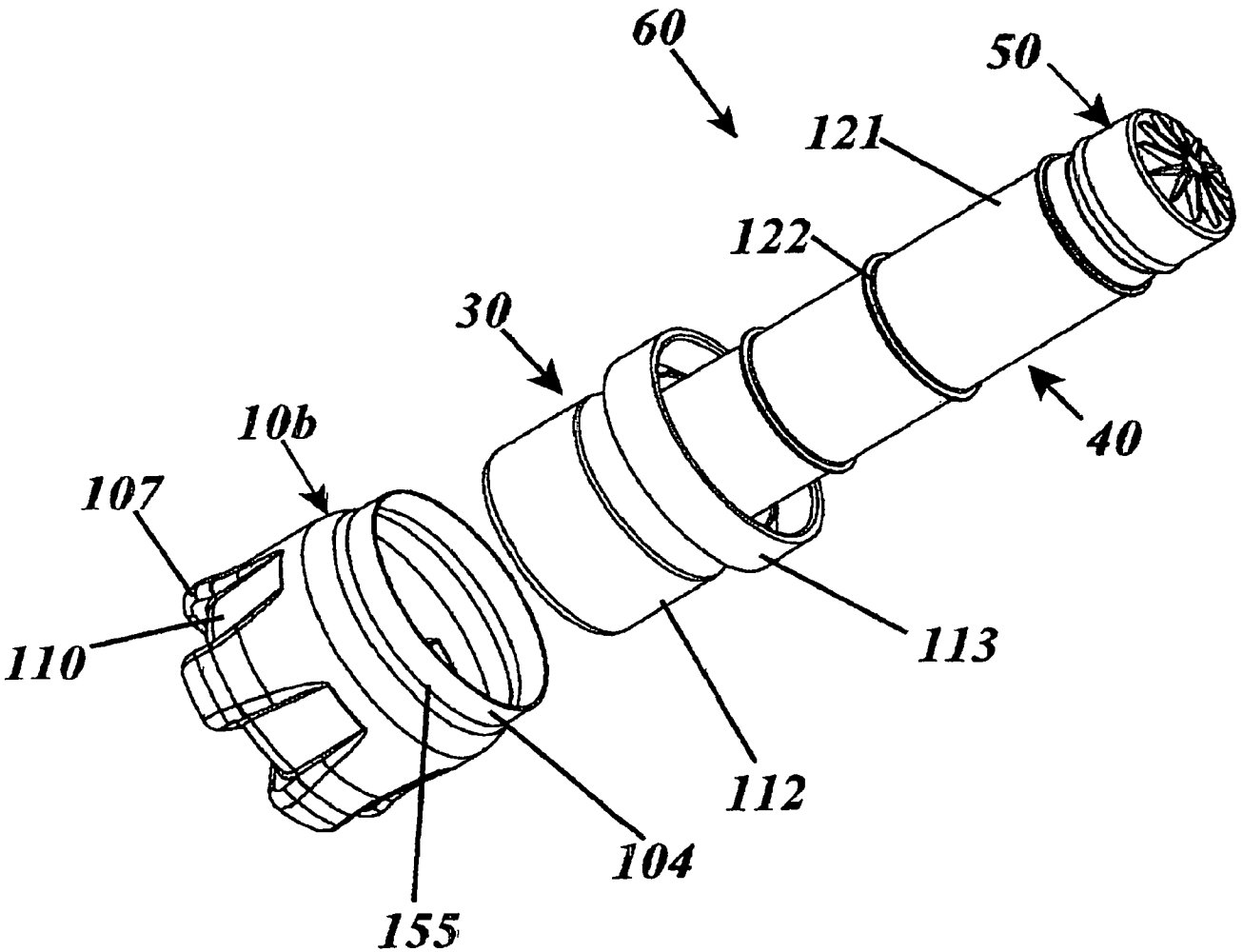
FIG. 15 shows the receptacle assembly being attached to the bottle bottom part.
Figure 16:
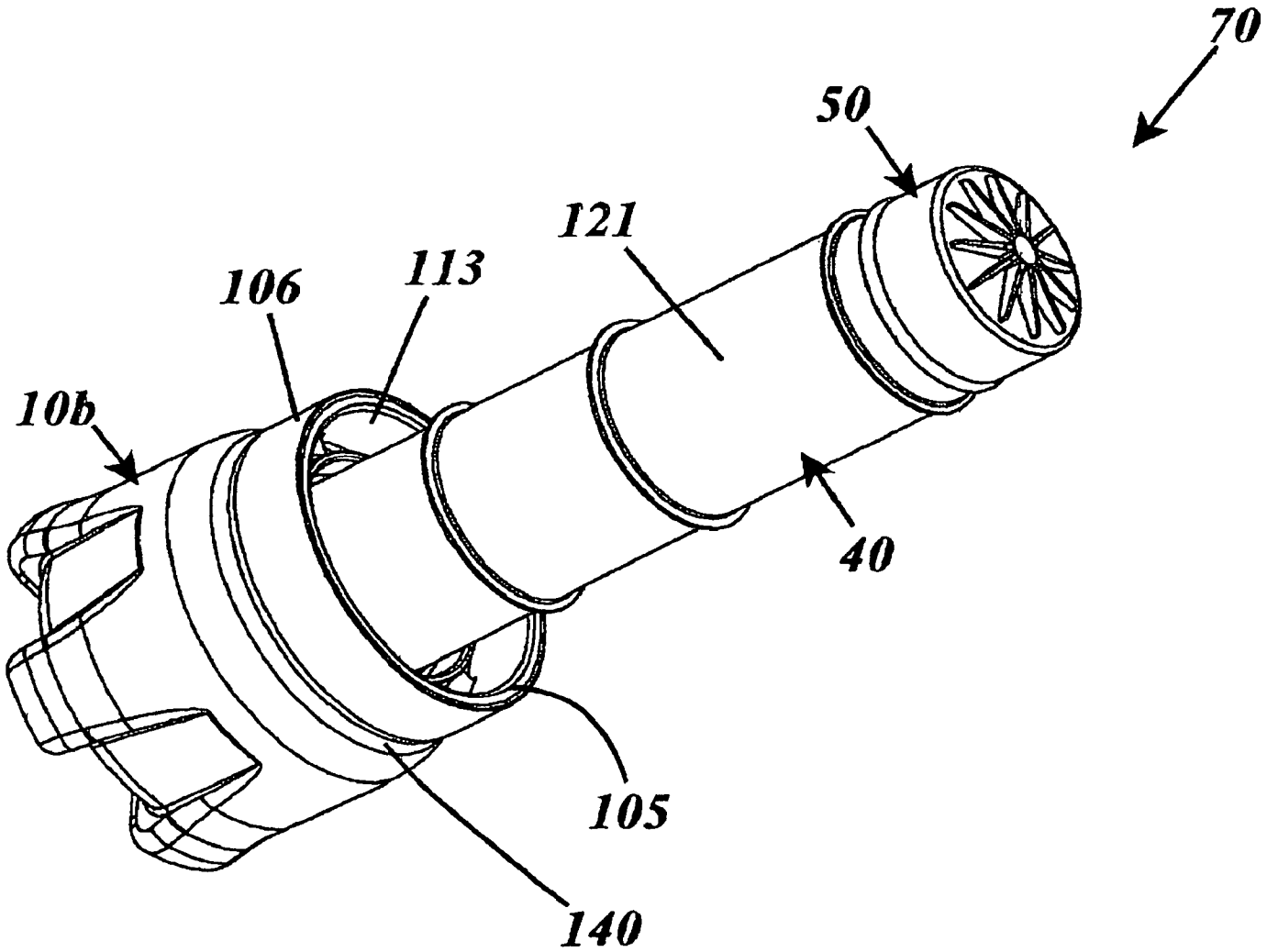
FIG. 16 shows the receptacle assembly attached to the bottle bottom part by heat shrinking the bottle surface.
Figure 17:
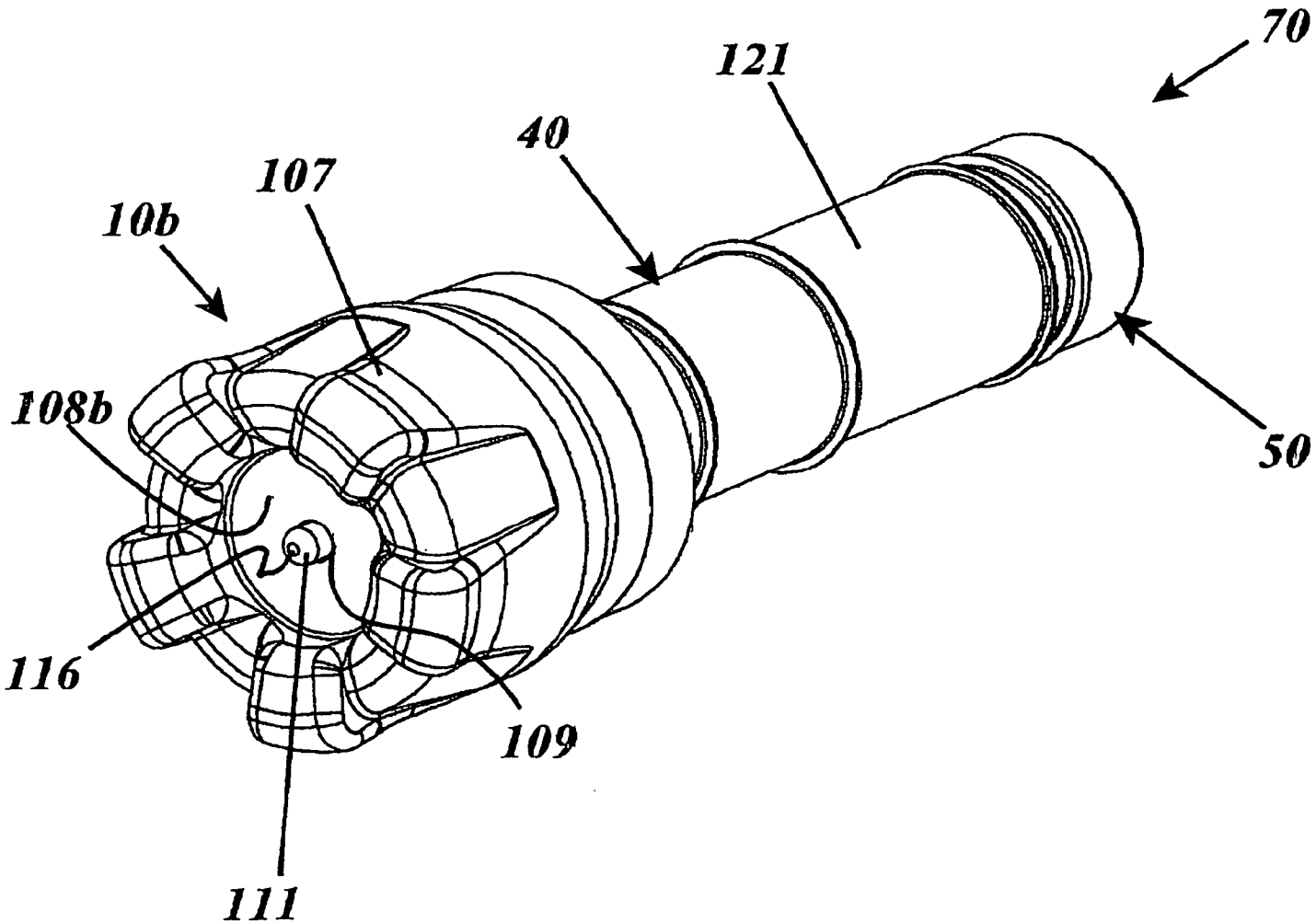
FIG. 17 shows the structure of the bottle bottom part and the canister cap member stud protruding through it.
Figure 18:
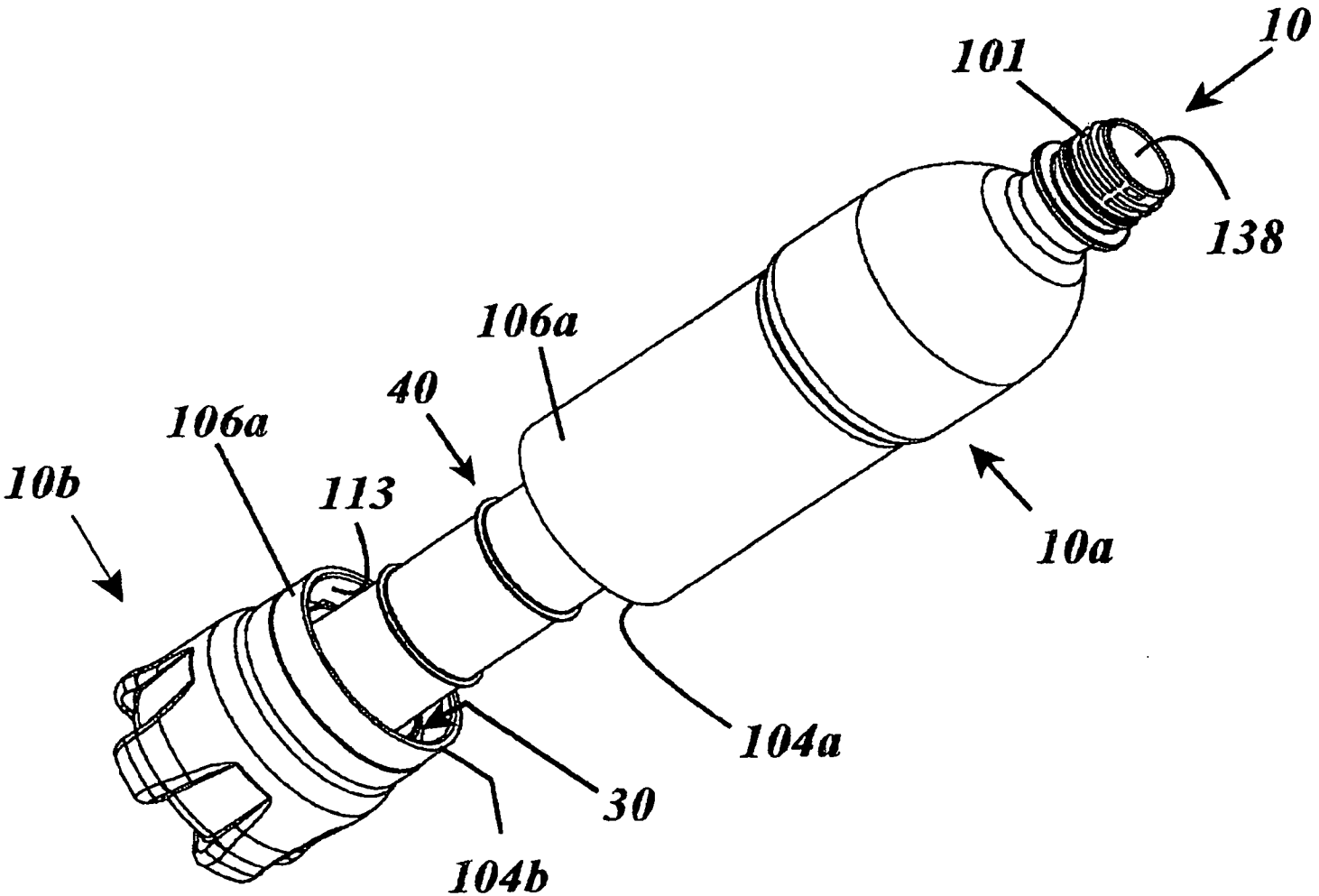
FIG. 18 shows the two parts of the bottle being assembled.
Figure 19:
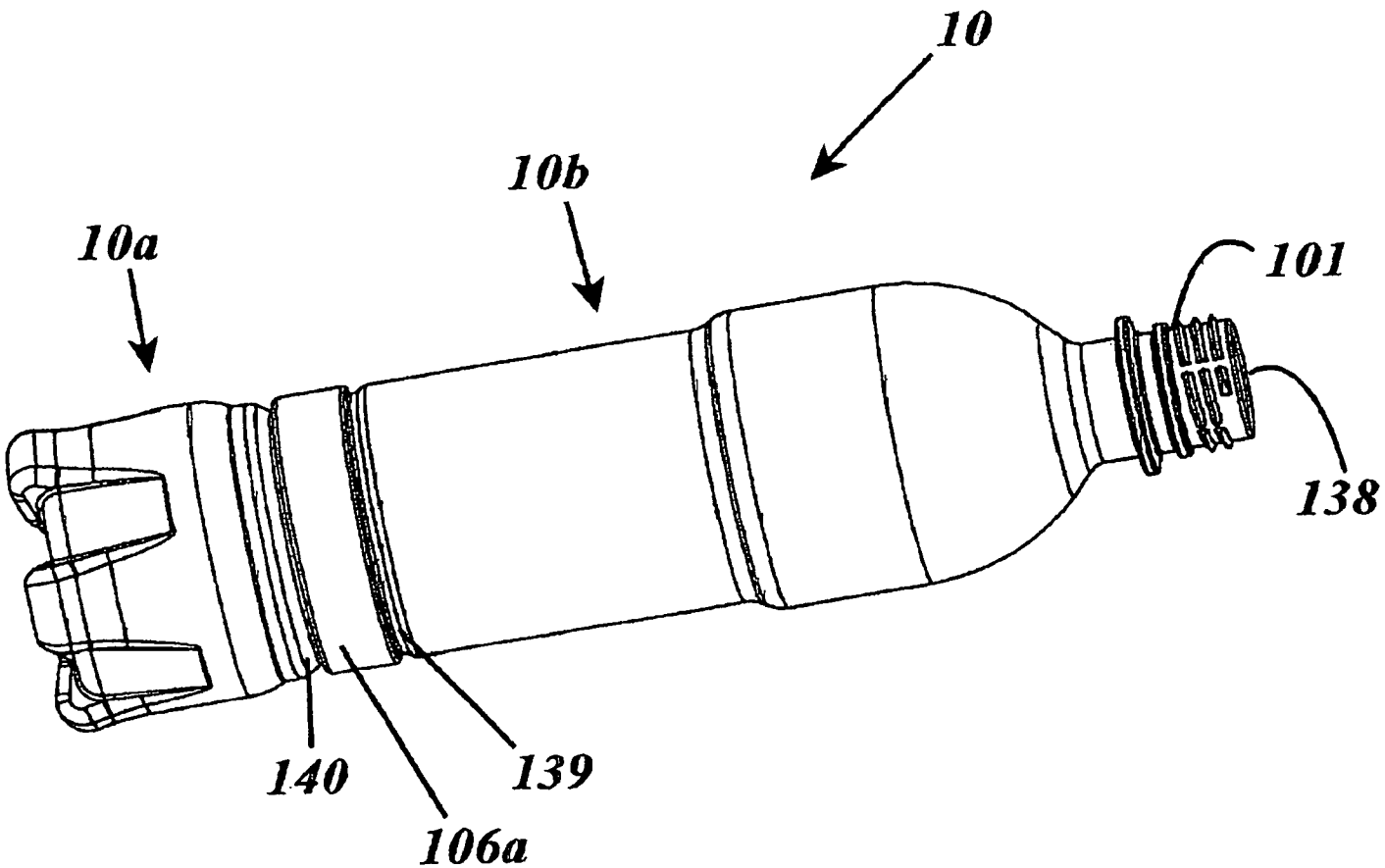
FIG. 19 shows a completed assembly of the bottle parts and the receptacle within it.
Figure 20:
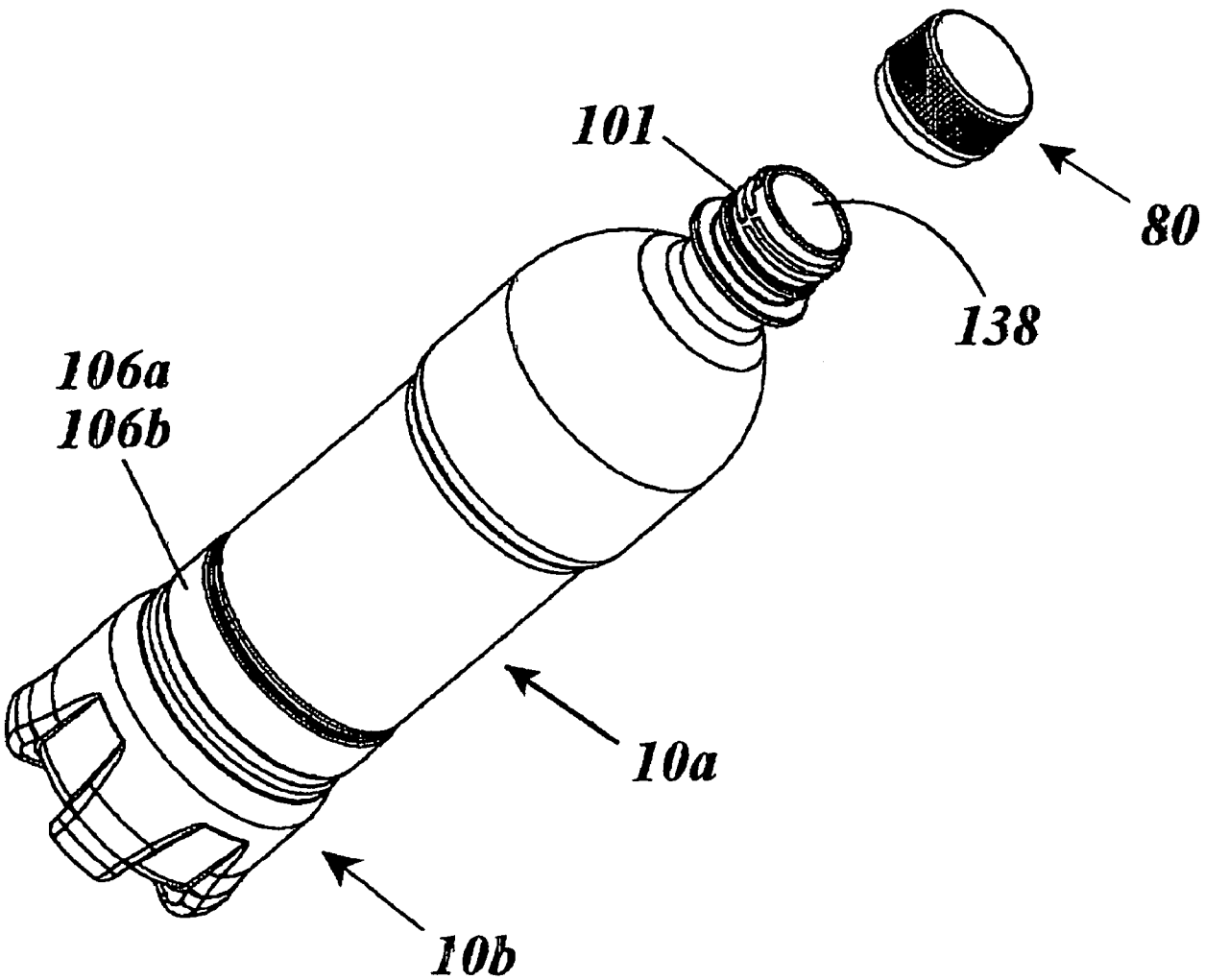
FIG. 20 shows the apparatus filled with product and being sealed with a threaded cap member.
Figure 21:
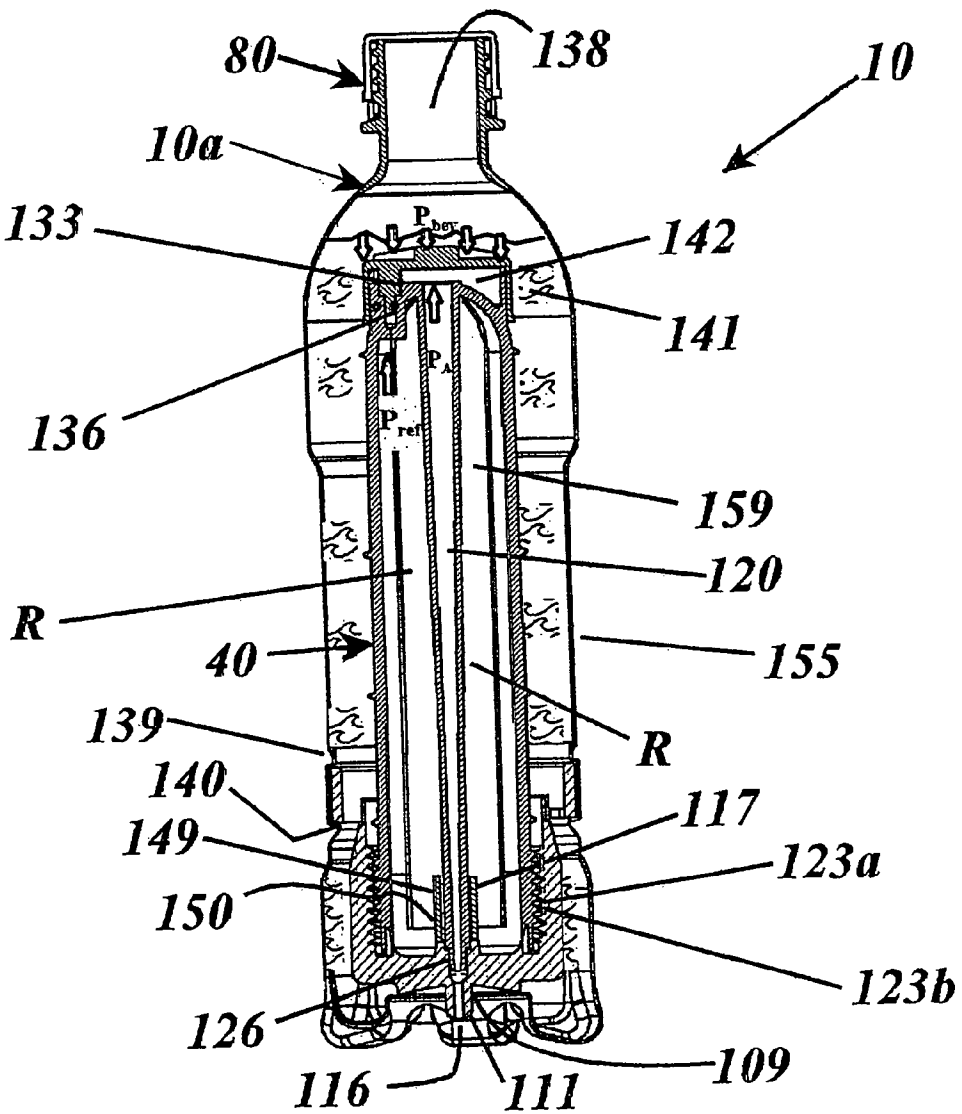
FIG. 21 shows a cut-away view of the assembly and the beverage pressure forces acting on the canister cap member.
Figure 22:
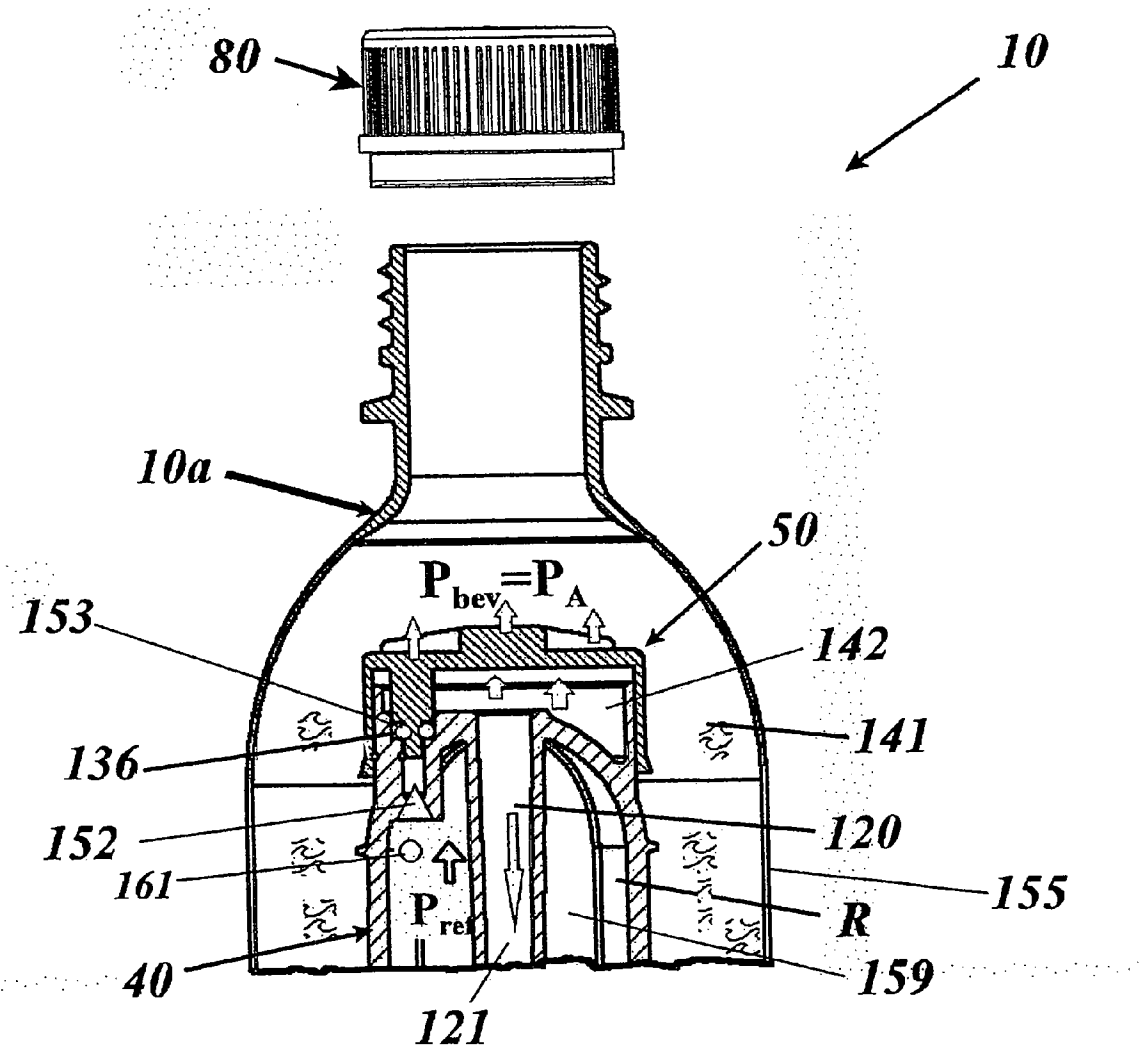
FIG. 22 shows the beverage pressure being released by the consumer opening the cap and the refrigerant pressure pushing the actuation cap and an exploded view of the time release bottle cap with the serrated expandable dome and the threaded cap body.
Figure 23:
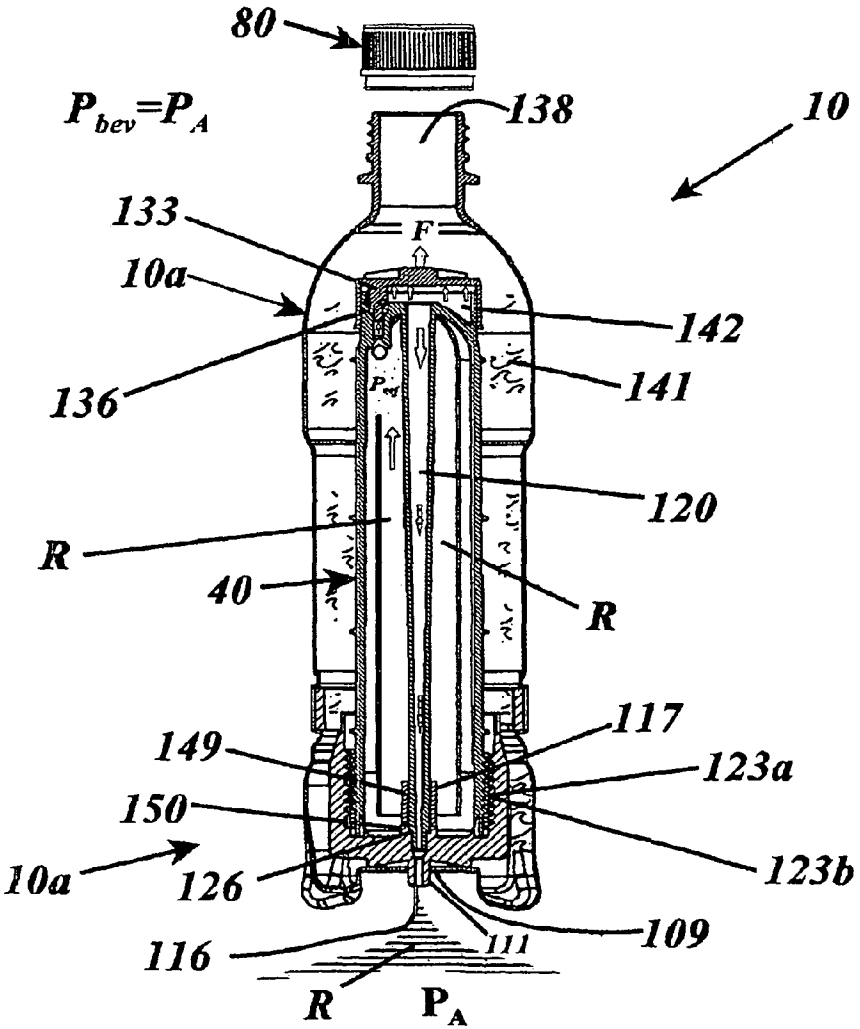
FIG. 23 shows beverage bottle apparatus with the refrigerant passing to atmosphere and cooling the beverage.
Figure 24:
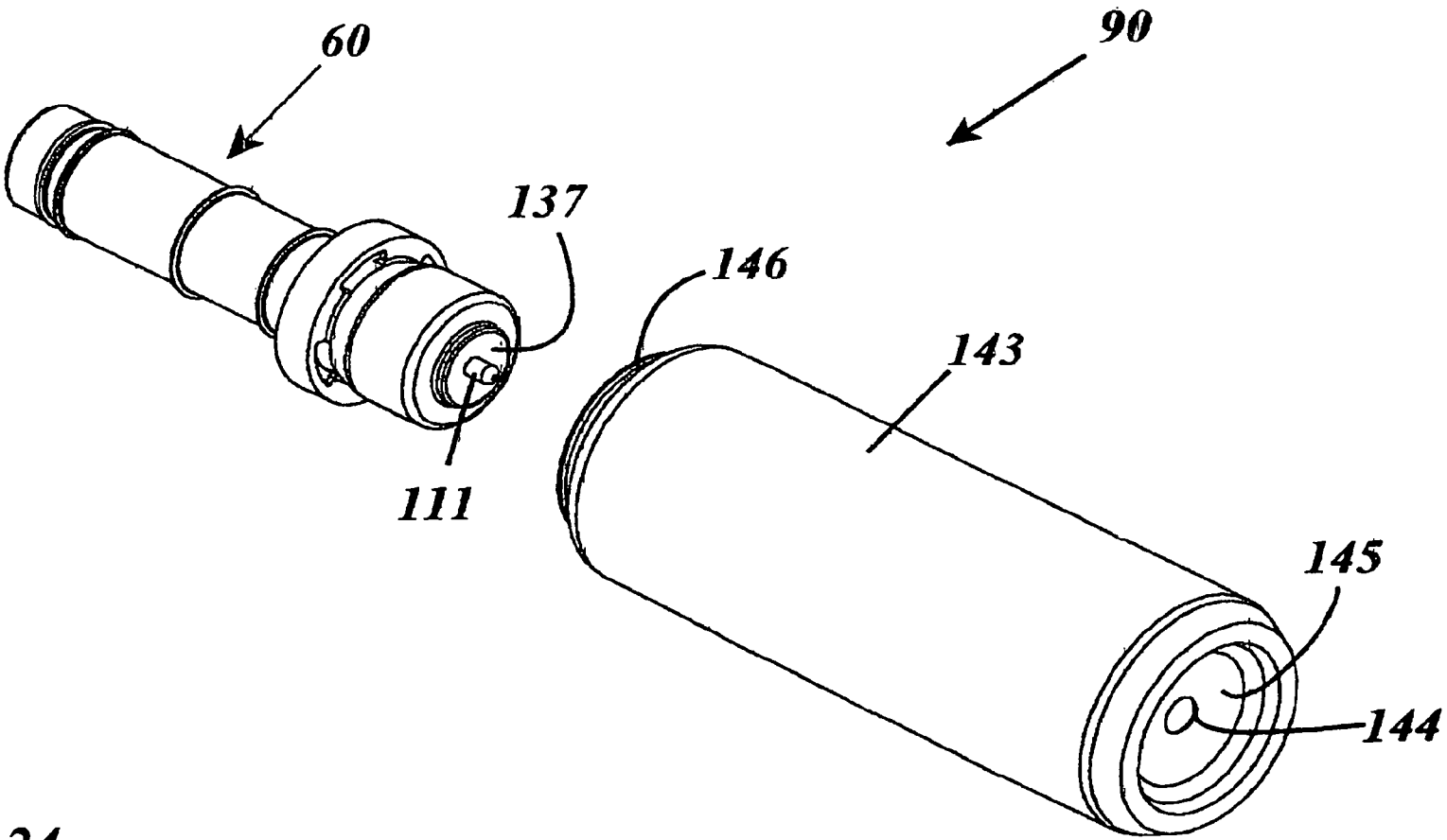
FIG. 24 shows the completed receptacle being assembled into the metal container.
Figure 25:
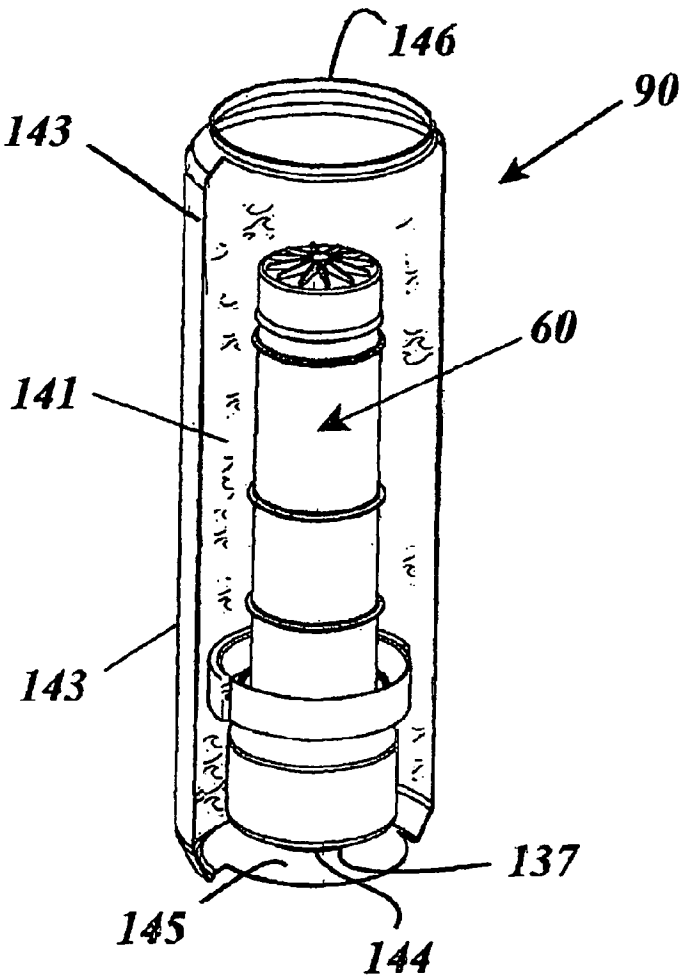
FIG. 25 shows a cut-away view of the metal container with the receptacle attached to the base dome and the canister cap stud passing through the can dome hole.
Figure 26:
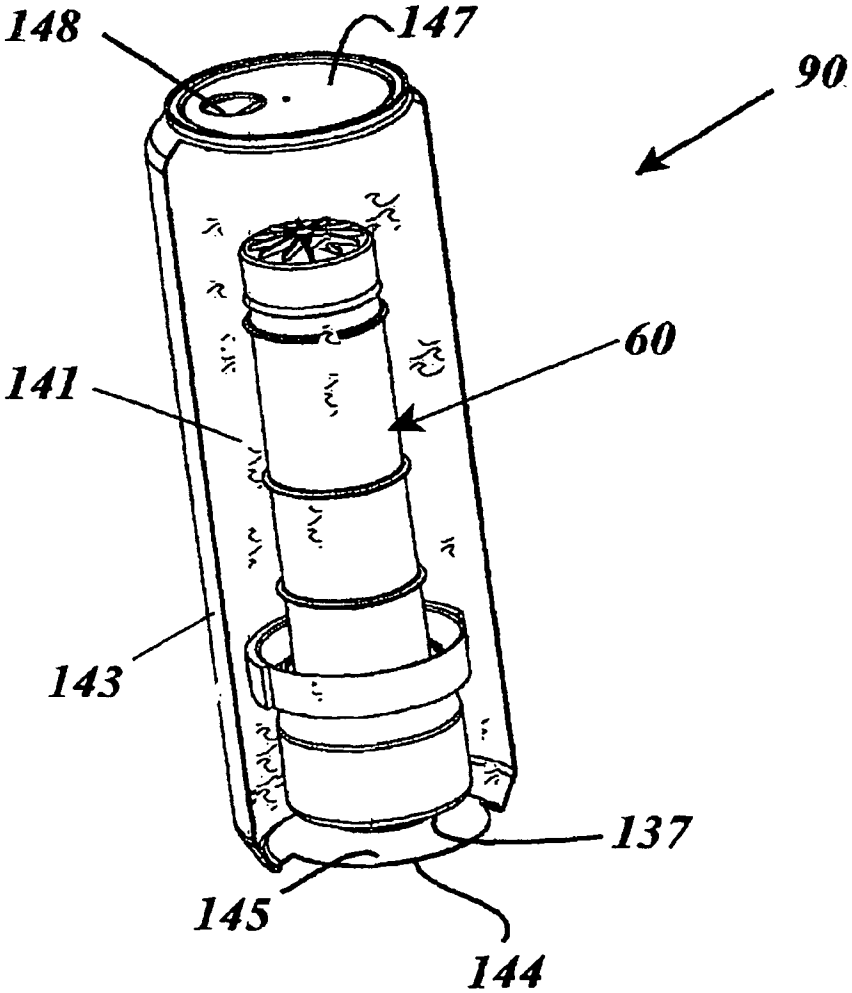
FIG. 26 shows a cut away view of the metal can with lid opening means opened for consumption and the receptacle assembly cooling the beverage contents.

Referring initially to FIGS. 1-30, the preferred of several possible embodiments is disclosed. More particularly, apparatus 10 is a conventional beverage or food container such as a plastic bottle 100 or metal container 143 for containing product 141 to be consumed. In the first embodiment, the bottle container is an injection-stretch-blown plastic bottle 100 with a conventional unified bottom dome 110 and a cylindrical side wall 155 terminating in an open bottle threaded neck 101. The bottle 100 is cut into two separate parts a bottle top member 10*a* and a bottle bottom member 10*b*, that can then be thermally sealed together using the refrigerant receptacle assembly 60 of the present invention. The bottle 100 is laser or knife cut into a bottle top member 10*a* and a bottle bottom member 10*b*. Alternately, either part can be injection molded from a suitable plastic material, so long as one of the bottle parts is made from a suitable heat shrinkable material. If the bottle top member 10*a*, and the bottle bottom member 10*b* are injection molded, then a heat shrink sleeve made from suitable plastic material can be used to fuse the two parts together later.

The bottle top member 10*a* consists of an open threaded neck 101 sealingly and contiguously connected to the cut portion of the bottle cylindrical side wall 106*a* which now terminates on a uniform circular bottle cut edge 104*a*. The bottle bottom member 10*b* consists of a bottle base dome 110 and bottle side wall 106*b* that are contiguously connected to a series of base protrusions 107 that form a stand for the bottle 100. The bottle base dome 110 has a central bottle base dome hole 109. The bottle base protrusions 107 connect contiguously as a unified wall 102 to a bottle bottom member cylindrical wall 106*b* that terminates on a uniform circular bottle cut edge 104*b*.

A specially designed high pressure refrigerant receptacle assembly 60 comprises of a cylindrical canister member 40 threaded sealingly unto a canister cap member 30. The canister member can be made from a suitable food grade plastic such as glass reinforced PET or pure PET. It could also be casted from aluminum of suitable grade. The canister member 40 has contiguously cylindrical wall 121 with a sealed canister base 124 and an open canister threaded neck 123*b*. The cylindrical canister member 40 has a through concentric canister central support tube 126 that fluidly connects the inside 160 of the canister member 40 to the canister top outer surface 118. The canister central support tube 126 has a closed-off end 163 at the canister open threaded neck 123*b* end and an open end 158 at the canister base 124*b*. Further, several thin-walled canister webs 125 connect the canister central support tube 126 to the inside canister cylindrical wall 154, so that the canister member 40 is structurally supported against lateral and hoop stresses due to high pressure forces. A small central cylindrical cut 160 on of material is removed from these canister webs 125 to form a rubber sleeve seat 158 for a cylindrical rubber sleeve 149 to seat.

Further, the canister outer wall 121 has canister hoop support bands 122 for supporting hoop stresses. The canister member 40 also has a canister top cylinder 118 that protrudes from its canister base 124. The canister top cylinder 118 is open ended terminating at a canister top cylinder edge 151. A small refrigerant port 119 passes through the canister base 124, off-set from the center of the canister member 40 and terminates at either end on a canister outer seal seat 153 and a canister inner seal seat 152 respectively so that there is fluid communication between the inside 160 of the canister member 40 and the outside of the canister member 40 to form a refrigerant port 119 for the receptacle assembly 60. The canister outer seal seat 153 and the canister inner seal seat 152 are preferably tapered but could be any shape depending on whether a ball valve or a different topology seal is used on either seal.

The canister cap member 30 is essentially a cylindrical unit with an open canister cap threaded-end 123*a* that sealingly mates to the canister member 40 open threaded neck 123*b* to form a sealed refrigerant receptacle assembly 60. The canister cap member 30 has a sealing ring member 113 attached to the main canister cap body by a series of small sealing ring support members 115. The gaps between the sealing ring support members 115 forms contents passageways 114 for the beverage or food product 141. The outer surface of the sealing ring member 113 fits slidingly inside the bottom bottle member inner cylindrical wall surface 105. A central cylindrical canister cap stud 111 protrudes centrally from the outer surface 137 of the canister cap member 30. A small canister cap stud hole 116 passes through the canister cap stud 111 to make fluid communication between the inside 160 and the outside of the canister cap member 30. A central cylindrical canister cap sealing sleeve 150 protrudes centrally in the inside 160 the canister cap member 30, so that the canister cap stud hole 116 breaks into it. The canister cap sealing sleeve 150 fits loosely and concentrically around the closed-off end 163 of the canister central tube member 126 and acts as a refrigerant passage way 117 through the assembled receptacle assembly 60 when needed.

Before the canister member 40 and the canister cap member 30 are sealingly mated, a small inner rubber seal member 149 is inserted to seal on the canister inner seal seat 152. A cylindrical rubber sleeve 149 is also inserted around the canister cap sealing sleeve 150. The canister cap member is threaded unto the canister member 40 and the cylindrical rubber sleeve 149 forms a seal between the canister cap sealing sleeve and the canister central support tube 126. The rubber sleeve seat 158 on the canister webs 125 act as a support seat for the rubber sleeve 149. Thus, advantageously, the refrigerant passageway 117 formed by the canister central support tube 126 and the canister cap sealing sleeve 150 is not yet in fluid communication with the inside 160 of the canister member 40. A continuous refrigerant passageway 117 can thus be created right through the assembled receptacle 60 unit by simply puncturing this seal. Advantageously before sealing the canister member 40 and the canister cap member 30, refrigerant R in the form of dry-ice or a liquefied cryogen may then be filled into the canister member 40 before sealing with the canister cap member 30. This has the advantage of easy charging and handling of the high pressure refrigerant. Alternatively, the unit could be charged with liquefied refrigerant mixture R through the canister cap stud member hole 116 by pumping refrigerant mixture R to pass through the rubber sleeve 149 which then acts as a one-way-valve for the refrigerant R to enter the receptacle assembly 60 through refrigerant passageway 117, but not exit from the receptacle assembly 60. Rubber sleeve 149 clamps tightly around the canister central support tube 126 and the canister cap sealing sleeve 150 so that refrigerant can expand the rubber sleeve 149 and pass into the receptacle assembly will compresses it and seals it shut again. Since, the canister central support tube 126 member has a central tube closed-off end 163 within the receptacle assembly 60, no refrigerant will pass through the refrigerant passageway 120 to the outside of the apparatus or into the actuation chamber 142 during liquid phase refrigerant R charging. In either case, the canister inner seal 161 will seal-off the refrigerant port 119 by means of pressure holding it in place against the canister inner seal seat 152 so that no refrigerant can escape from the receptacle assembly 60.

If the refrigerant is in the form of dry-ice, or cryogenic liquid that can be poured into the canister member 40 before sealing said canister member with canister cap member 30, then the central tube closed-off end 163 should first be drilled open so that there is fluid communication between the atmosphere and the actuation chamber 142. In this case the refrigerant will be trapped inside 160 of the canister member 40, since the rubber sleeve 149 and the canister inner seal 161 are in place.

An actuation cap member 50 is designed to be slidingly placed over the canister top cylinder 118 to act as part of an actuation valve system for the unit. The actuation cap member 50 is a cup shaped member with an open-ended cylindrical wall 129 contiguously connected to a top wall 127. Top wall 127 is reinforced with ribs 128 to make it flex less under pressure.

An actuation cap protruding stud member 133 protrudes from the inner bottom surface 132 of the actuation cap member 50. A stepped stud member 135 acts a s a shaft sealing surface. A protruding actuation pin 130 projects centrally from the actuation stud member 135. The top concentric surface of the actuation cap protruding stud member 135, acts as an actuation cap seal seat 134 for the canister outer seal 136. Before assembling the actuation cap member 50 with receptacle assembly 60, the canister outer seal 136 is placed by piercing it using the actuation pin 130 and seating said canister outer seal 136 on the actuation cap seal seat 134. In case an o-ring is used, no piercing is needed, since the actuation pin 130 can easily passed over the o-ring hole. Preferably, canister outer seal 136 is a rubber ball of small diameter.

The inside surface 128 of actuation cap member 50 is slidingly and sealing fitted over the canister top cylinder 118, to form a sealed actuation chamber 142. At the same time, the actuation pin 130 is also inserted into the refrigerant port 119 to fit snugly inside it and the canister outer seal 136 is made to just contact the canister outer seal seat 153. The canister outer seal 136 is compressible but during assembly it is not in a compressed state but just makes contact with the actuation cap seal seat and the canister outer seal seat 153. The actuation pin 130 just contacts the canister inner seal 161.

In the first embodiment for bottles, the receptacle assembly 60 is inserted into the open bottom bottle member 10*b* so that the sealing ring member 113 fits slidingly inside the bottle bottom member 10*b* inner cylindrical wall surface 105 and the canister cap stud 111 projects sealingly through a bottom base dome hole. The sealing ring member top edge 113*a* should be at least an eighth of an inch or so below the bottle bottom member cut edge 104*b*. Heat is applied to the bottle bottom member cylindrical wall 106*b* just around the region where the sealing ring member 113 is located inside the bottle bottom member 10*b* while the subassembly 70 is spun for uniform heat distribution. The bottle bottom member cylindrical wall 106*b* shrinks rapidly so that the bottle bottom member 10*b* inner cylindrical wall surface 105 clamps sealingly unto the sealing ring member cylindrical surface 113*c* by compression. The bottle cut edge 104 of the bottle bottom member 10*b* forms a heat-shrunk bottle base sealing curl 139 around the canister cap sealing ring member top edge 113*a*.

The bottle bottom member cylindrical wall 106*b* also form a sealing curl around the sealing ring member bottom edge 113*b*. The bottle top member 10*a* is then placed so that it slides over the shrunk bottle bottom member cylindrical wall 106*b*. The bottle top member cut edge 104*a* lies approximately an eighth of an inch below the sealing ring member bottom edge 113*b*. Heat is applied to the heat shrinkable region around the area of the sealing ring member 113 whilst the assembly 10 is spun. Since the material the bottle is made from is an injection stretch-blown material, it will tend to shrink when heat is applied to its enlarged expanded blown diameter. The bottle top member cylindrical wall 106*a* shrink rapidly so that it clamps sealingly unto the combined shrink surfaces of the bottle bottom member 10*b* and the sealing ring member 113. The bottle top member cut edge 104*a* then also forms a bottle top sealing curl 140 over the bottom sealing ring member bottom edge 113*b* of the canister cap member sealing ring member 113. This way, the receptacle assembly 60 is sealing attached to the bottle top member 10*a* and the bottle bottom member 10*b* forming a contiguously sealed beverage bottle assembly 10. The completed bottle assembly 10 is similar in shape and size to conventional plastic beverage bottles, but with the receptacle assembly 60 within it.

The original bottle 100 is preferably injection-stretch-blown material such as from a Polyethylene-Teraphthalate, (PET) so that it is a heat shrinkable material. However, it could also be made from two injection molded parts that are fused together by means of a heat shrink sleeve 162. Thus, the assembly 10 can handle a tremendous amount of carbonation pressure stresses.

The high pressure receptacle 60 is designed to store high pressure liquefied cryogenic gases, such as carbon-dioxide, mixtures of aerosol propellants and carbon-dioxide, or a matrix held aerosol propellants with smell ingredients such as a combination of CO2 and carbon atoms. The refrigerant R used for the cooling process may be designed as a slurry of an activated carbon matrix with $CO_2$ gas trapped inside the matrix.

Figure 27:
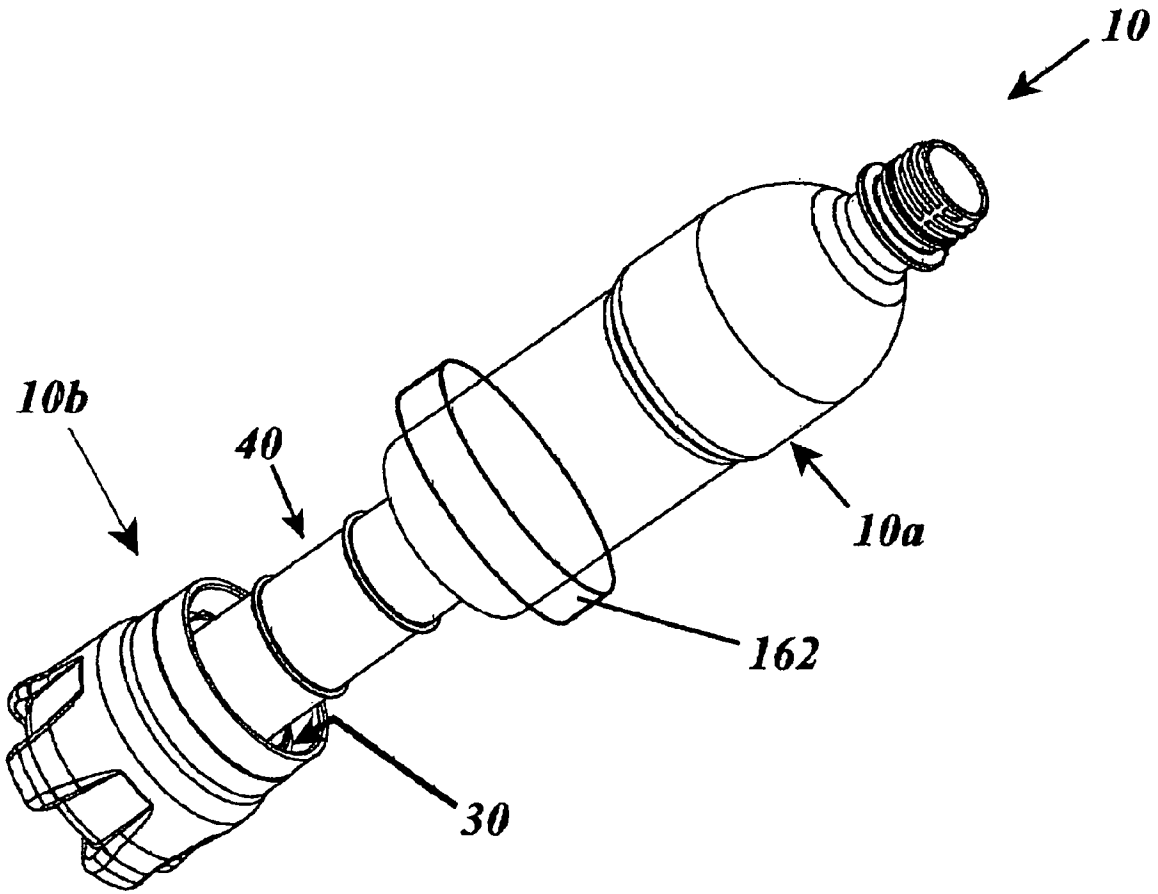
FIG. 27 shows the bottle top part and the bottle bottom part as injection molded versions, and a heat shrinkable band used to sealingly assemble the two parts together after assembly of the receptacle member.
Figure 28:
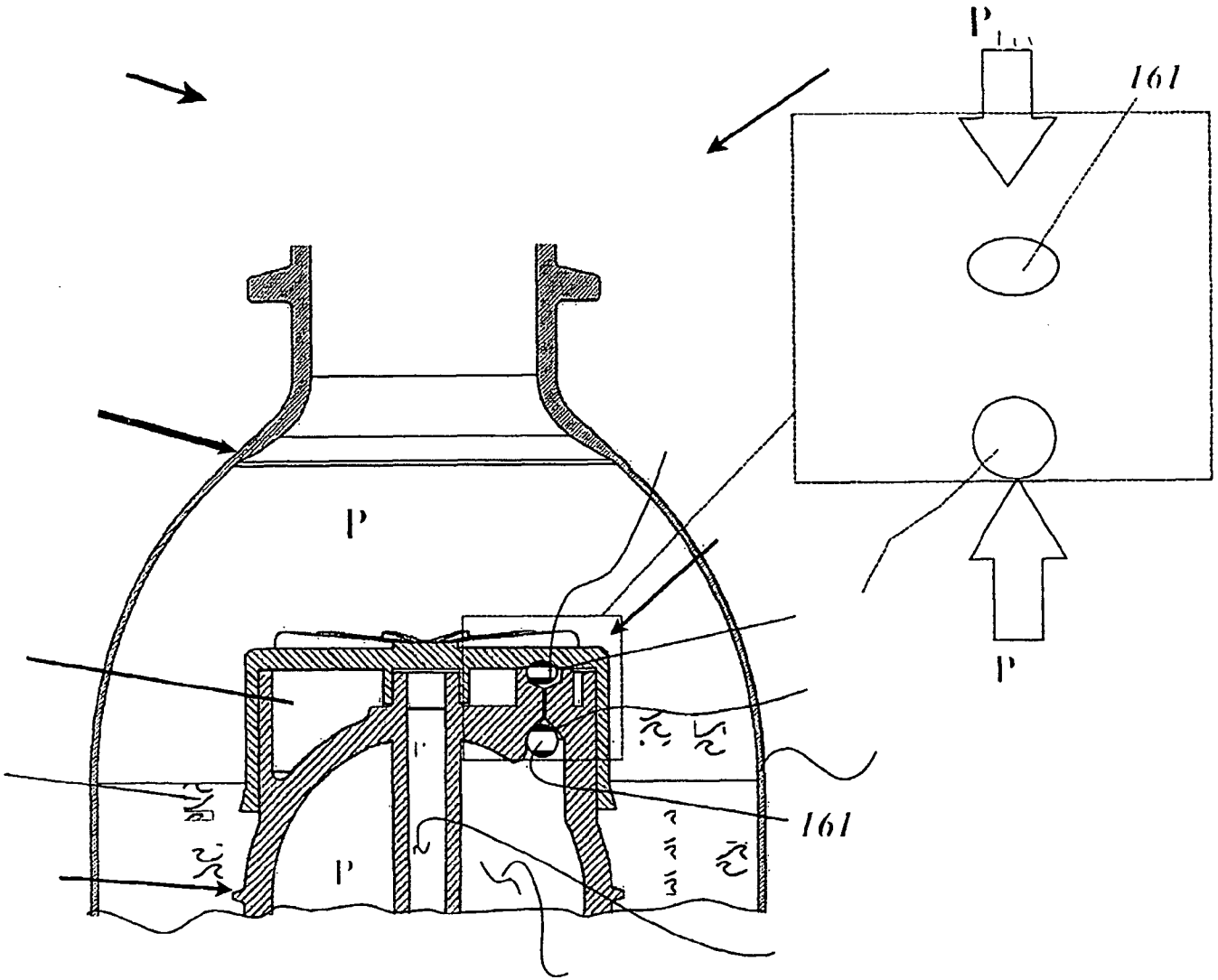
FIG. 28 shows details of the canister valves and their functional aspects.
Figure 29:
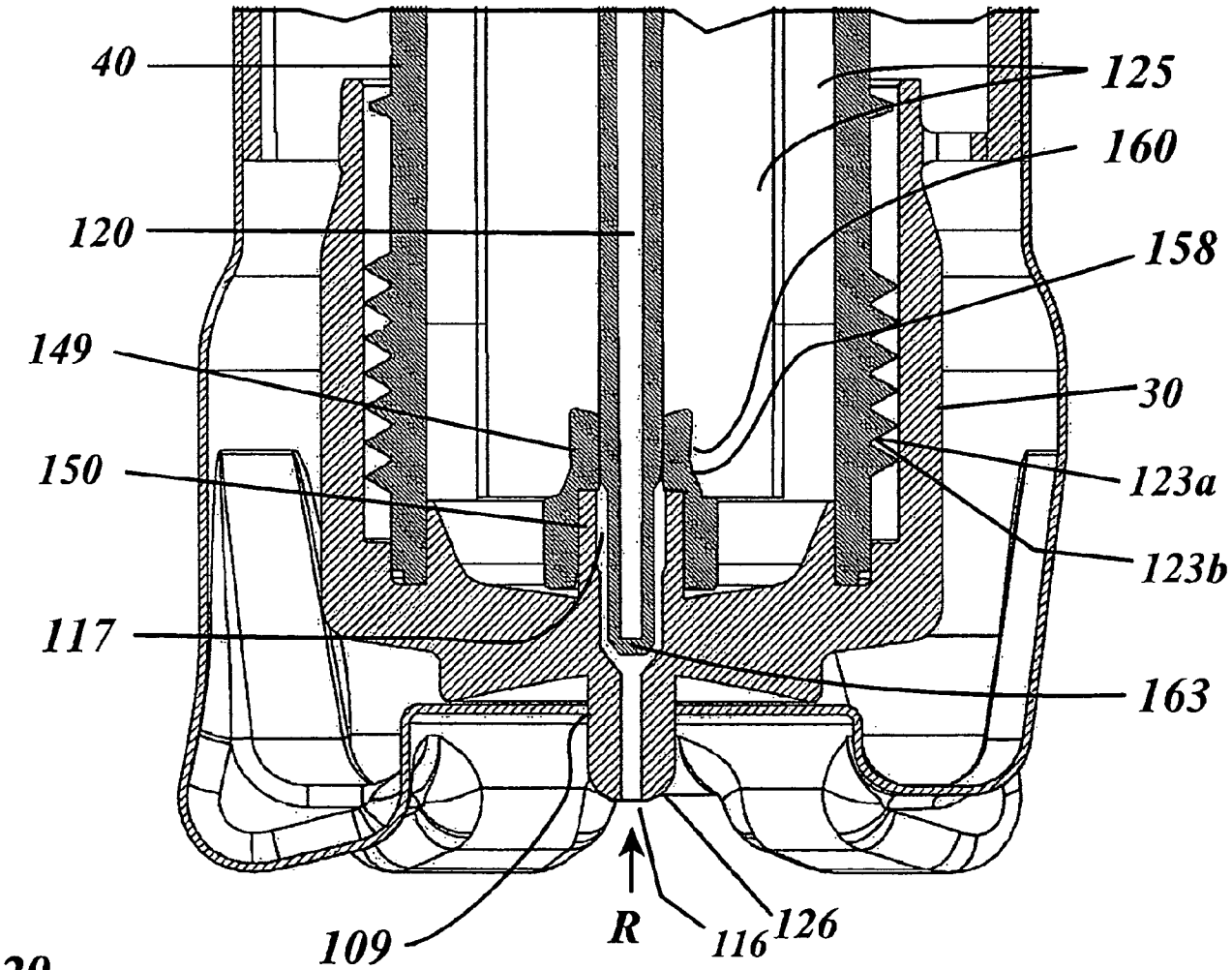
FIG. 29 shows the rubber sleeve valve in a sealed position.
Figure 30:
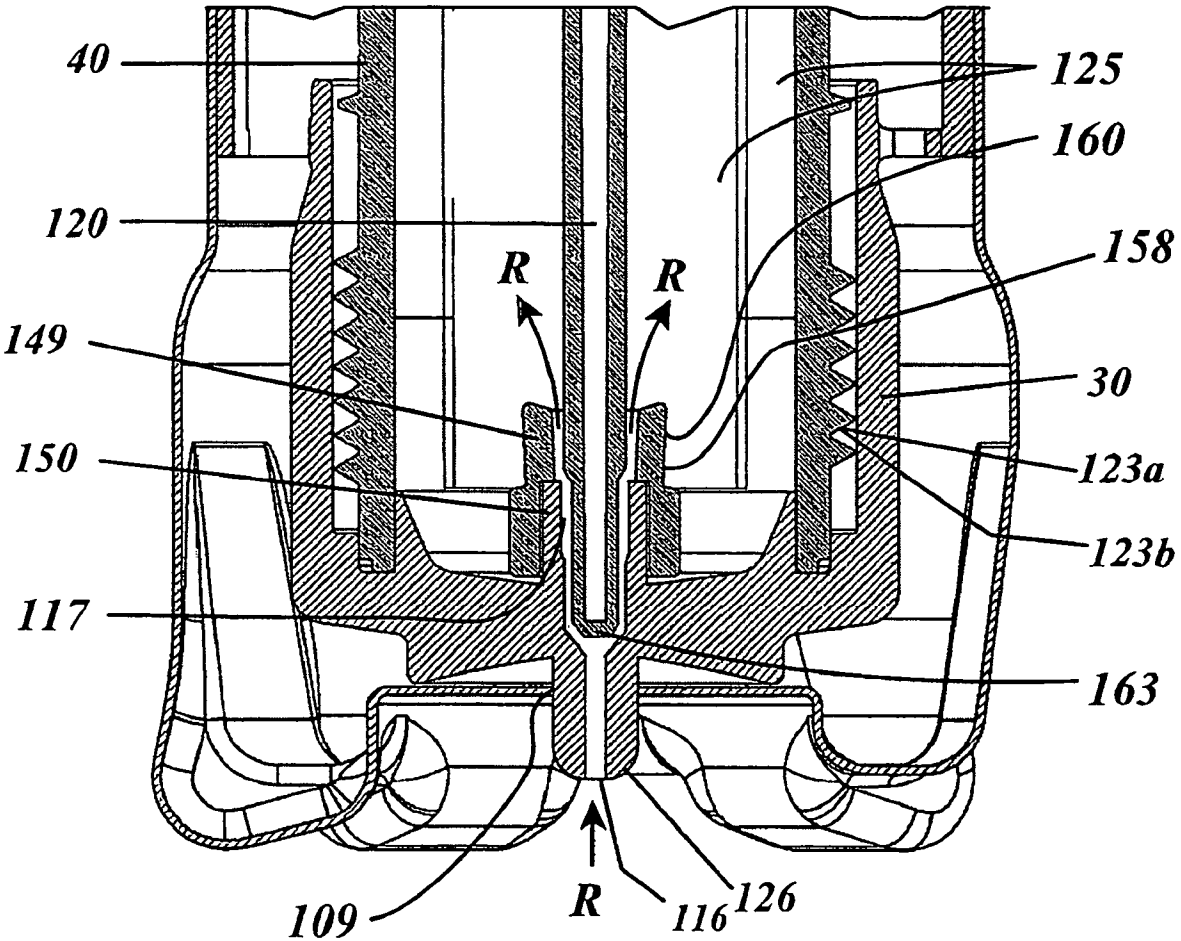
FIG. 30 shows the rubber seal valve opened by refrigerant being pumped through it.

In the case when both the bottle bottom member 10*b*, and the bottle top member 10*a* are injection molded from a suitable plastic material, a heat shrink sleeve 162 can be used to fuse the two bottle parts together as shown in FIG. 27. Also, the canister member 40 and canister cap member 30 need not be made with threads. After following the method of assembly for which the canister inner seal 161 is inserted into the canister inner seal seat 152, the canister member 40 and the canister cap member 30 can be fused together by means of over-molding or gluing with a chemical bonding agent. One skilled in the art will recognize that there are many ways, shapes and forms to make the bottle parts and the canister parts to achieve the aim of this invention without loss of generality.

The apparatus further comprises a conventional bottle cap 80 for sealing off the beverage product 141 after being filled.

The apparatus 10 is then filled with carbonated product 141 and then the bottle cap 80 fitted to bottle top member 10*a* open threaded end to seal off the product 141. The finished apparatus is then stored for later use or sale. During storage, carbonation pressure slowly compresses the actuation cap member 50 because the sealed actuation chamber 142 formed between the actuation cap member 50 and the canister top cylinder 118 is at atmospheric pressure due to the refrigerant passageway through the receptacle assembly 60 and through the canister cap stud 111 hole. As carbonation pressure builds up, the actuation cap member 50 slowly compresses the canister outer seal 136 forming a hermetic seal with the canister outer seal seat 153. Since the actuation cap member 50 experiences more force from carbonation pressure $P_{bev}$, due to its larger surface area than the canister inner seal 161 experiences from the refrigerant R pressure, it compresses the canister outer seal 136 and forms a better seal between the canister outer seal 136 and the canister outer seal seat 153, so that slight leaks of refrigerant R between the canister inner seal seat 152 and the canister inner seal 161 will progressively make the canister inner seal 161 loose its effective pressure differential $P_A$ with the atmosphere and then it will fall away from the canister inner seal seat 152 and drop to the bottom of the receptacle assembly 60 by means of gravity. Since the canister inner seal 161 will be deformed by the original acting pressure force of the refrigerant $P_{bev}$, it will not readily form a seal within the receptacle should it again come into contact with the canister inner seal seat 152.

One will find that the only way for refrigerant R to pass from the inside 160 of the canister 40 to the atmosphere is through refrigerant port 119. This port is blocked off by the canister outer seal 136 which in turn must be held in place by the pressure force acting on the canister actuation cap member 50. In the case when the refrigerant R charge must be done in liquefied form after the apparatus 10 is fully assembled, one must wait for the complete apparatus 10 to be assembled so that carbonation pressure within the apparatus 10 can seal the canister outer seal 136 against the canister outer seal seat 153 before charging to prevent refrigerant from flowing through the actuation chamber.

In this case when one must charge after the beverage filling process, (as in the case of high temperature filling), one must first wait for enough carbonation pressure to build up on the inside of the apparatus so that the canister outer seal 136 seats firmly against the canister outer seal seat 153 to block off this passageway. Then, one charges refrigerant R through the canister cap stud hole 116 and after completion of charging, one drills through the closed-off end 163 of canister central support tube 126 to create fluid communication between the actuation chamber 142 and atmosphere.

Advantageously, since for fermentation and bacterial removal, beer, juices and other food products are made at relatively high temperatures compared to chilled carbonated sodas, these high temperatures will be detrimental to a cryogenic liquefied gas. Then, the cryogen is charged through the canister cap stud hole 116 into the apparatus 10 after the complete apparatus 10 has been assembled and filled with beverage contents and has cooled down. This way, the apparatus 10 and its contents can first cool down to a suitable temperature, so that the cryogenic refrigerant can be easily charged in liquefied form through the canister cap stud-hole 116. The carbonation pressure is then in place to keep canister outer seal 136 in the sealing position.

Thus the apparatus can be used for beers and sodas, and can be charged before or after the beverage filling process. This also gives the advantage of programming the processes of transportation and supply of the apparatus as either a pre-filled cryogenic receptacle, or an empty receptacle. For example some small beverage companies require no part in the charging process of the refrigerant, so that a pre-filled apparatus can be supplied to them for simple beverage filling in a conventional beverage filling plant. Alternatively, the apparatus could be supplied empty to a beer filling plant, so that the beer is first filled and then the refrigerant is charged at a place where the beverages bottles will be sold. For this instance, a savings in transportation could be deemed of essential value if the cryogenic weight is subtracted. Further, the apparatus could be charged only when needed, to prevent long term loss of ingredients.

When a consumer opens the beverage container by using unscrewing the lid member 80, carbonation pressure $P_{bev}$ is released from the apparatus 10 to atmospheric pressure $P_A$ and the actuation cap member 50 looses its holding force against the canister outer seal 136. The canister outer seal 136 is pushed away from the canister outer seal seat 153 by the refrigerant R pressure $P_{ref}$, and the refrigerant R escapes from the receptacle assembly 60 into the actuation chamber 142. The actuation cap member 50 is pushed upward slightly by pressure $P_{ref}$ of the refrigerant R gas, and the liquefied refrigerant R stored in the form of a cryogenic fluid in the receptacle assembly 60 is now free to evaporate and remove heat from the beverage contents 141 by expanding to the atmosphere through the refrigerant passage way 119 at the center of the canister central support tube 126, and then through the refrigerant port 116 to the atmosphere.

In the case of a metal container, cylindrical can 143 is provided with a unified bottom dome 145 and a top sealing rim 146 in the manner of a classic beverage container. A hole 144 is made through the center of the dome 145 to snugly hold the canister cap central stud member. The canister cap domed outer surface is designed to smoothly match the diameter and shape of the dome of the container. A Food and Drug Administration approved glue could be used to bond the receptacle to the container dome, but in general, the snug fitting of the canister cap stud 111 and the container dome hole is enough, since after assembly, pressure from the carbonated product 141 will firmly hold the canister cap domed outer surface to the container dome. After assembling, the container is filled with carbonated beverage and then sealed off with a conventional lid with an opening means.

The finished apparatus is then stored for later use or sale. During storage, carbonation pressure slowly compresses the actuation cap member 50 because the sealed actuation chamber 142 formed between the actuation cap member 50 and the canister top cylinder 118 is at atmospheric pressure due to the refrigerant passage way 120 through the receptacle and through the canister cap stud hole 116. As carbonation pressure builds up, the actuation cap member 50 slowly compresses the canister outer seal 136 forming a hermetic seal with the canister outer seal seat 153. Since the actuation cap member 50 experiences a lot more force from carbonation pressure due to its larger surface area than the canister inner seal 161 experiences from the refrigerant pressure, it compresses the canister outer seal 136 and forms a better seal between the canister outer seal seat 153 so that slight leaks between the canister inner seal seat 152 and the inner rubber seal will progressively make the inner rubber seal loose its effective pressure differential with the atmosphere and then it will fall away from the canister inner seal seat 152 and drop to the bottom of the receptacle assembly 60 by gravity. Since it will be deformed by the original acting pressure force of the refrigerant, it will not readily form a seal within the receptacle if it should again come into contact with the canister inner seal seat 152.

Again, as in the previous embodiment, when a consumer opens the beverage container by using the container opening means, carbonation pressure $P_{bev}$ is released from the metal container to atmospheric pressure $P_A$ and the actuation cap member 50 looses its holding force against the canister outer seal 136. The canister outer seal 136 is pushed away from the canister outer seal seat 153 by the refrigerant R pressure $P_{ref}$ and the refrigerant R escapes from the receptacle assembly 60 into the actuation chamber 142. The actuation cap member 50 is pushed upward slightly by pressure $P_{ref}$ of the refrigerant R gas, and the liquefied stored in the form of a cryogenic refrigerant R in the receptacle assembly 60 is now free to evaporate and remove heat from the beverage contents 141 by expanding to the atmosphere through the refrigerant passage way 120 at the center of the canister central support tube 126, and then through the refrigerant port 116 to the atmosphere.

In the case when the container contents 141 is not carbonated as in the case of water, a slight charge of nitrogen can be added to maintain a holding pressure $P_{bev}$. Then the same process applies for either metal cans or plastic bottles.

A self-cooling container apparatus is further provided for retaining container contents such as food or beverages; and a container contents release mechanism for releasing the container contents from the container and also for effectuating the release of liquefied gas stored in a high pressure receptacle.

A. Alternate Embodiment

FIGS. 31-40 depict an alternate embodiment of a cryogenic apparatus for chilling food products, such as a beverage contained within a beverage container 200. Beverage container 200 may comprise a conventional beverage or food container such as a plastic bottle or metal container for containing product to be consumed. Beverage container 200 may be fabricated from any suitable manufacturing process, including those disclosed herein above.

Figure 31:
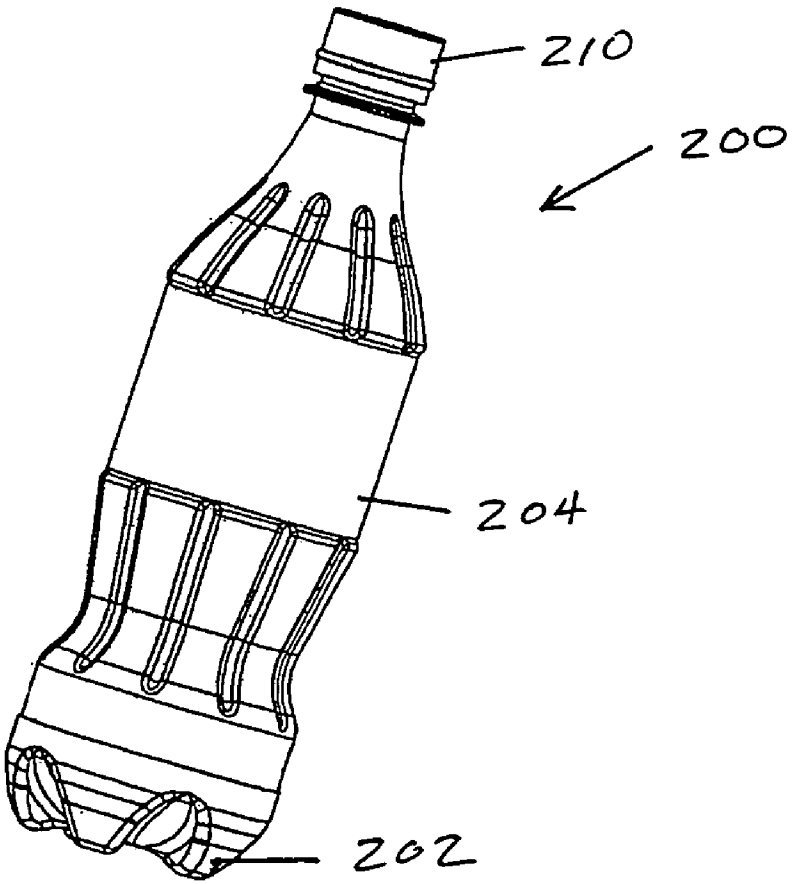
FIG. 31 is a perspective view of a plastic container adapted with an alternate embodiment cryogenic apparatus in accordance with the present invention.
Figure 32:
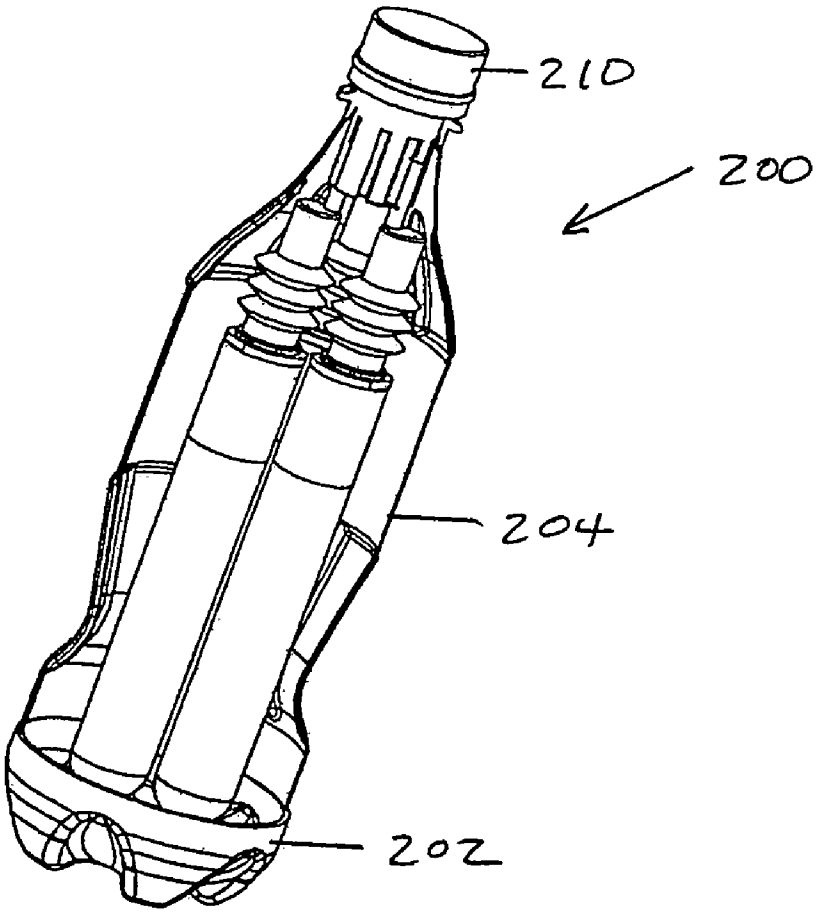
FIG. 32 is a perspective view thereof with a portion of the plastic container cut-away.

As seen in FIGS. 31 and 32, beverage container 200 comprises a plastic bottle having a bottom 202, and a side wall 204 terminating in an open top portion 206 having a an externally threaded neck 208 for mating engagement with an internally threaded cap 210. At least one, and preferably a plurality, of high pressure refrigerant cylinders, referenced as 220 are inserted through open top portion 206 and neck 208 and received within beverage container 200. This embodiment will be disclosed as using three such cylinders, however, it is noted that any suitable cylinder number is considered within the scope of the present invention. Each cylinder 220 is sized for insertion through neck 208 thereby allowing insertion into a plastic bottle manufactured in accordance with conventional manufacturing techniques. As discussed in more detail below, cylinders 220 are automatically activated to cause chilling of the food product contained withint container 20 upon removal of cap 210 and exposure of the cylinders to atmospheric pressure.

Figure 35:
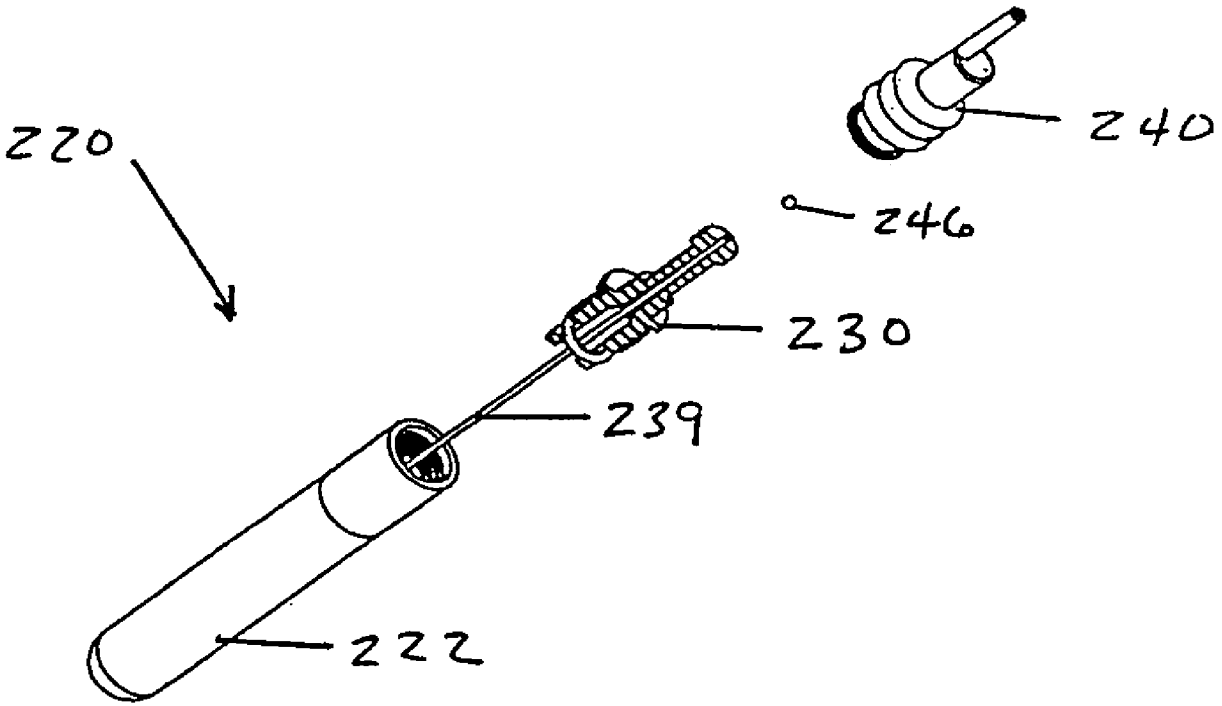
FIG. 35 is an exploded perspective view thereof.
Figure 36:
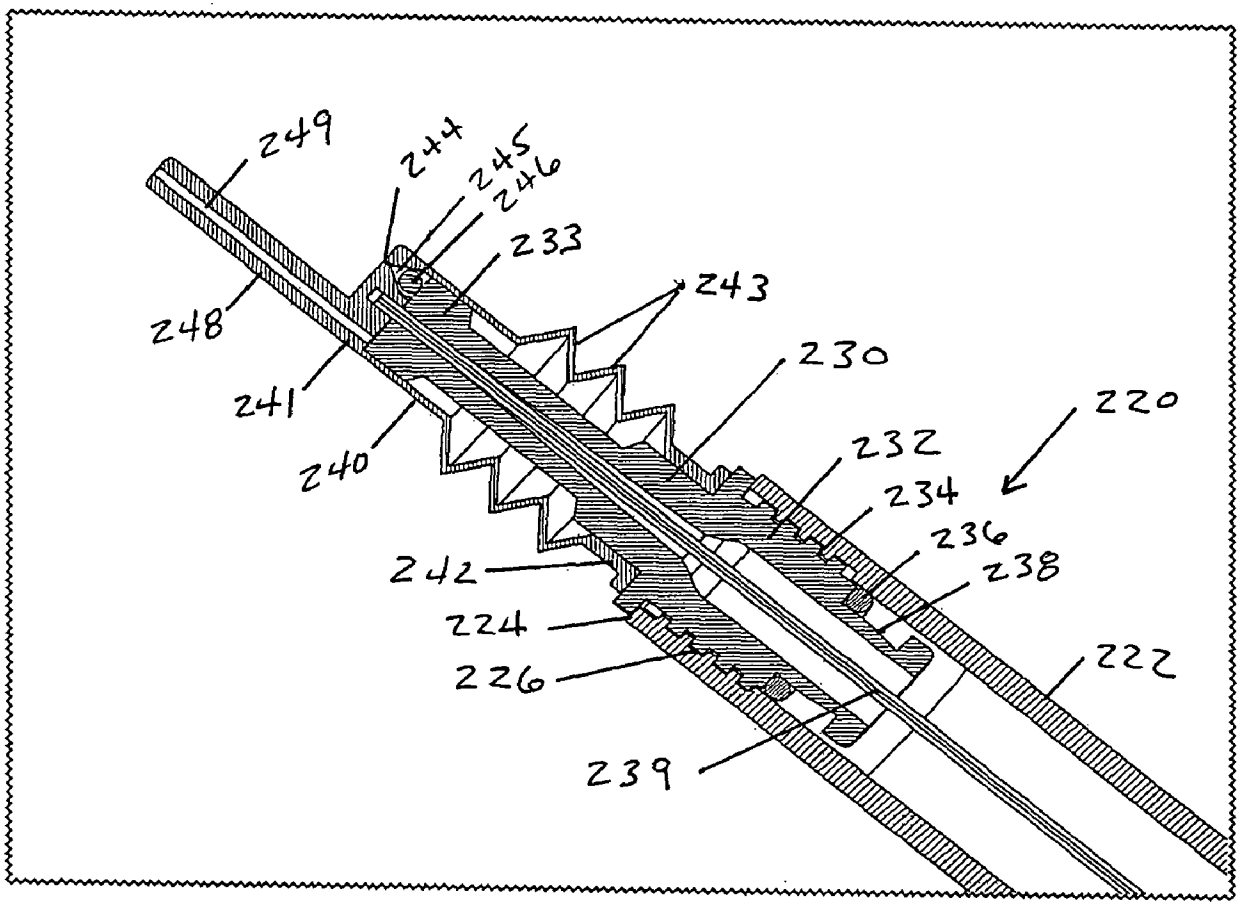
FIG. 36 is a partial side sectional view thereof.
Figure 37:
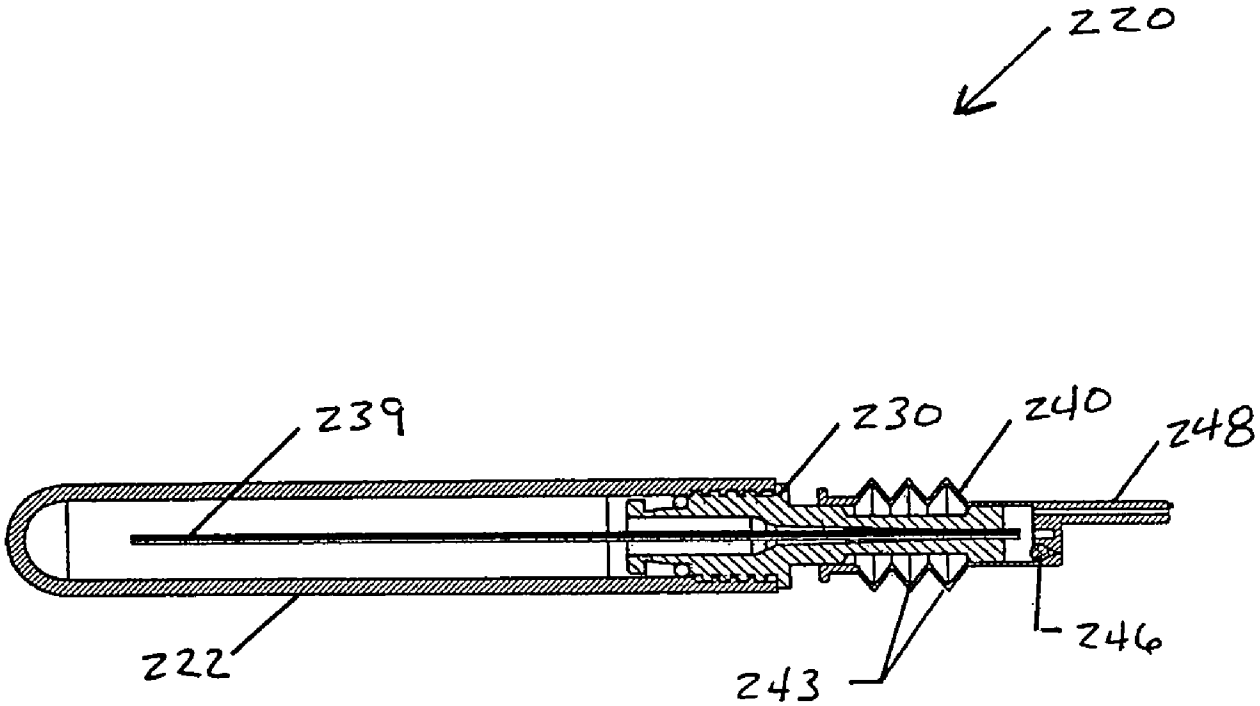
FIG. 37 is a side sectional view thereof.

As best seen in FIGS. 35, 36, and 37, each cylinder 220 comprises a high pressure refrigerant receptacle assembly including a cylinder body 222 having an open end 224 with internal threads 226. A refrigerant metering device 230 having a generally cylindrical lower end 232 adapted with external threads 234 is in threaded engagement with the open end 224 of cylinder body 222, and an upper end 233. Metering device 230 may further include an O-ring 236 received within a peripheral groove 238 defined on the lower end 232 of metering device 230. Metering device further includes an axial aperture extending completely therertherough, which aperture is defined by an inner wall that converges from the lower end 232 to the upper end 233 to define an outlet. Metering device 230 may further include an elongate capillary tube 239 received within the axial aperture formed therein.

A cap 240 is axially received in covering relation with the upper end 233 of metering device 230 and functions as an actuation valve as more fully discussed herein. Cap 240 includes a top end 241, and an open bottom end 242 sized for insertion over the upper end 233 of metering device 230 and adapted to be secured relative thereto by press fit, or any other suitable securing means. Cap 240 further includes a mid-portion defining an accordion-type bellows 243 to allow for axial expansion of cap 240. The top end portion 241 of cap 240 includes a first aperture 244 leading to an inverted V-shaped notch 245 and a spherical sealing member 246 sized for removable reception within notch 245. V-shaped notch 245 and sealing member 246 function as a charging check valve to allow gas under pressure to enter cap 240 via aperture 244 while preventing gas therein from escaping when the pressure within the cap exceeds the pressure outside the cap thereby charging the apparatus with a positive pressure (e.g. pressure greater than atmospheric). Cap 240 further includes a generally cylindrical recess 247 sized for removably receiving the end of capillary tube 239. Finally, cap 240 includes a radially offset, axially projecting tubular member 248 defining an axial opening 249 that places the interior of cap 240 in fluid communication with the exterior space.

Figure 33:
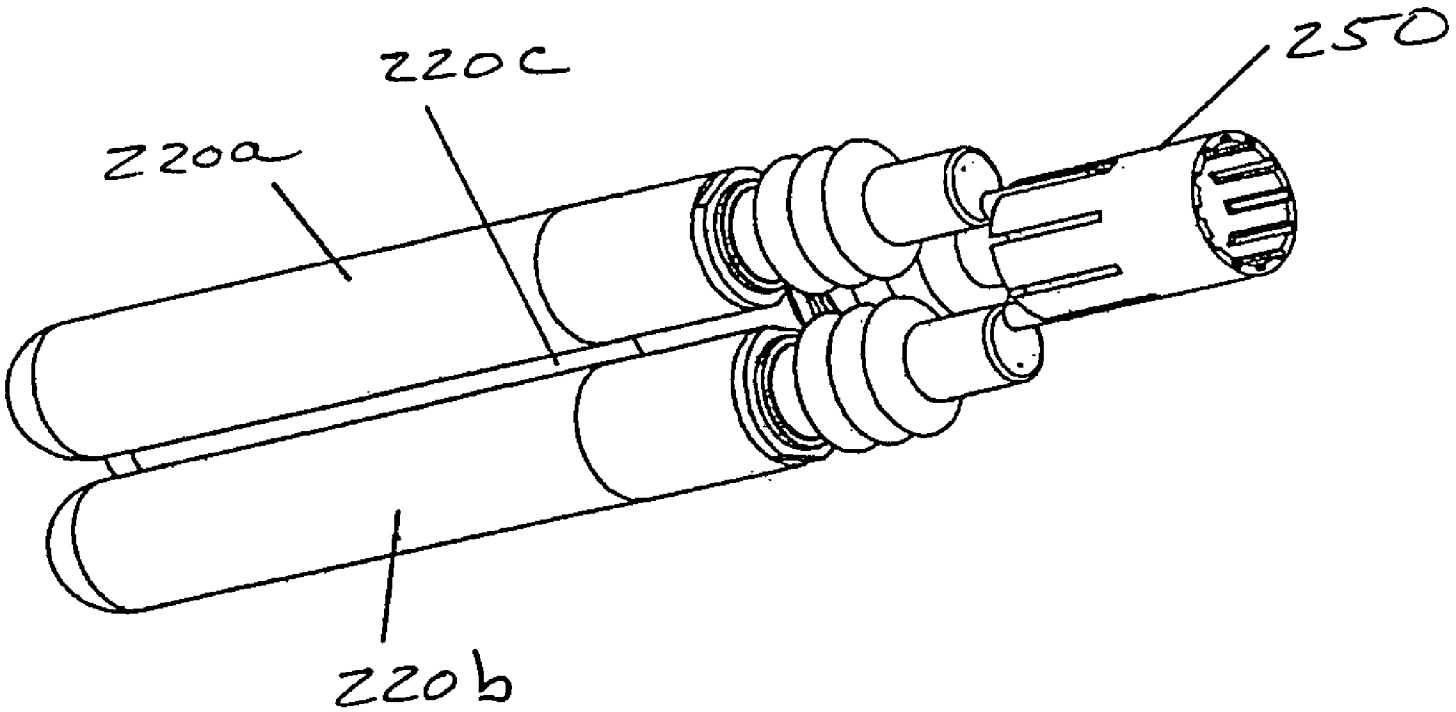
FIG. 33 is a perspective view of the alternate embodiment cryogenic apparatus.
Figure 34:
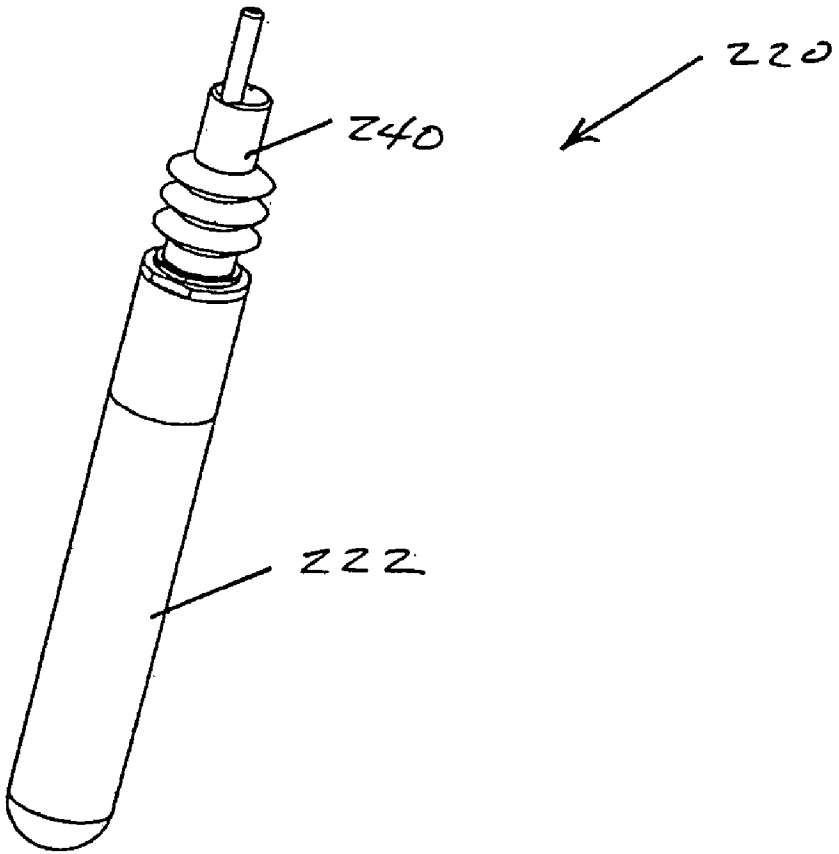
FIG. 34 is perspective view of cartridge for use therewith.
Figure 38:
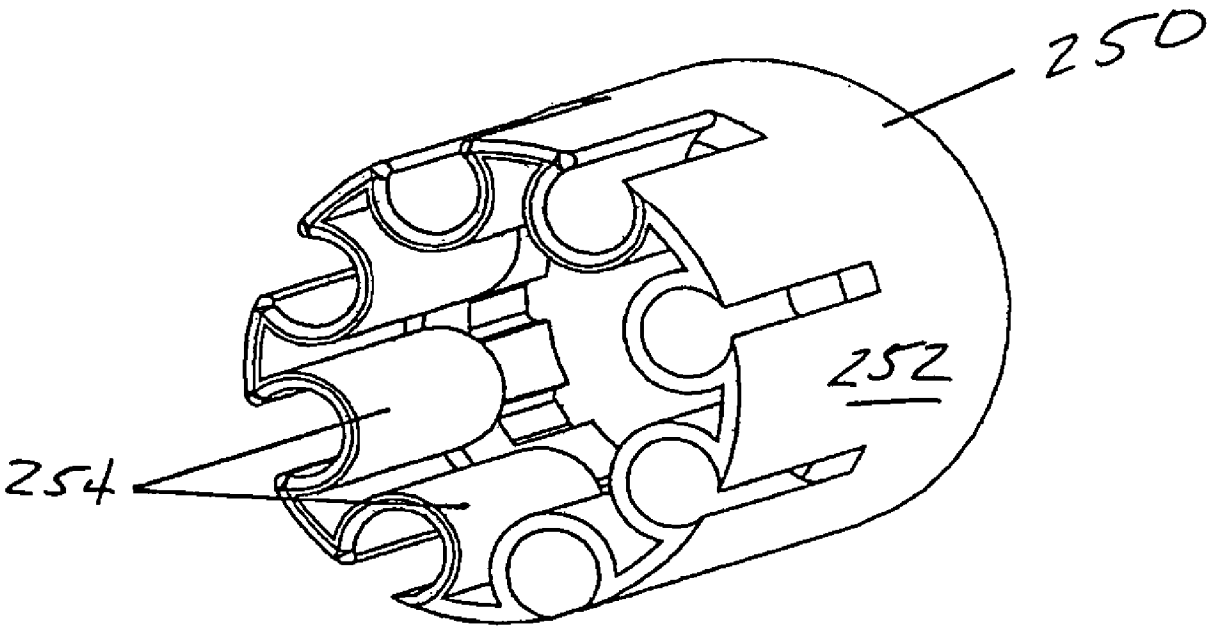
FIG. 38 is a perspective view of a retaining cap for use therewith.
Figure 39:
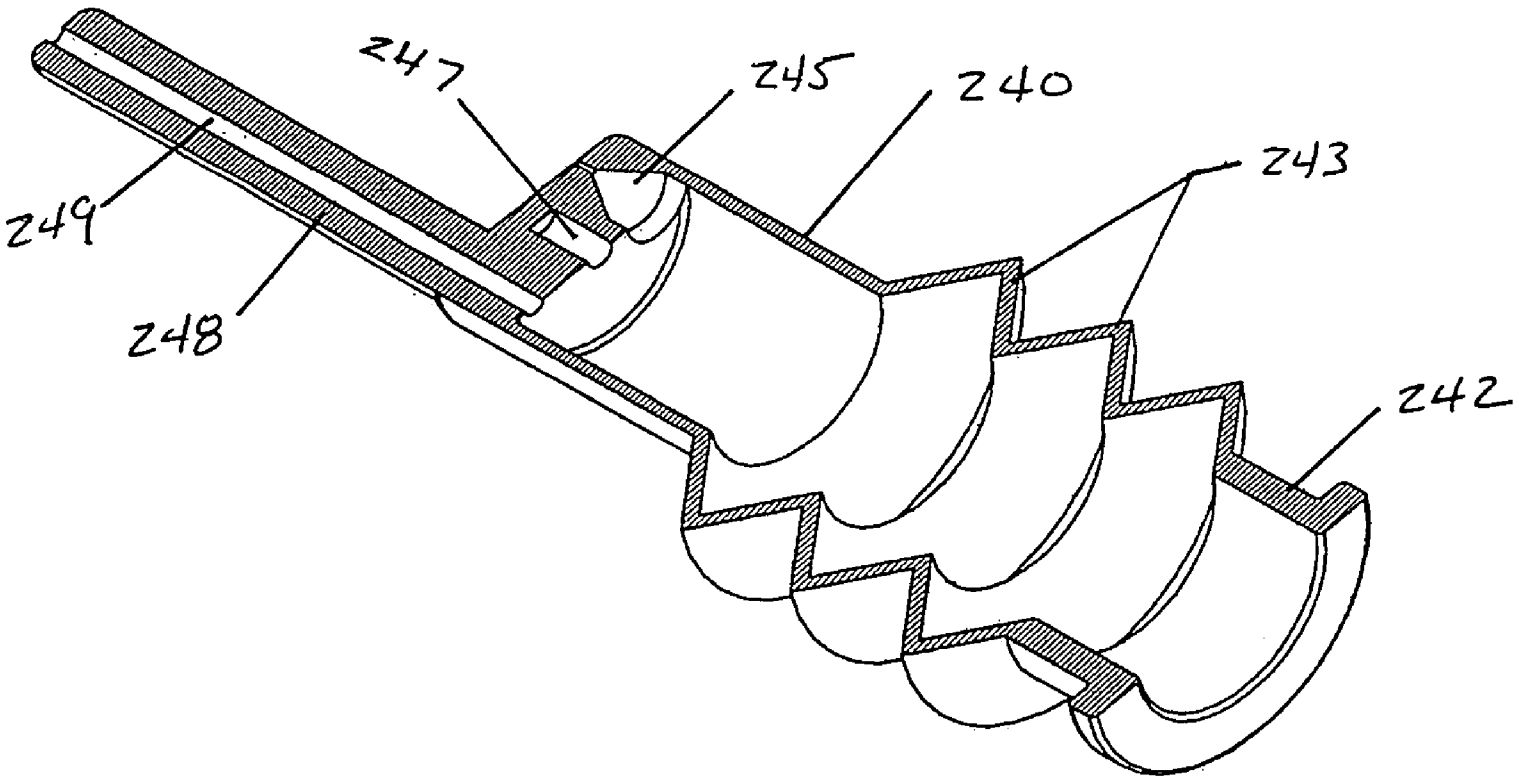
FIG. 39 is a perspective sectional view of the cryogenic gas release cap for use therewith.
Figure 40:
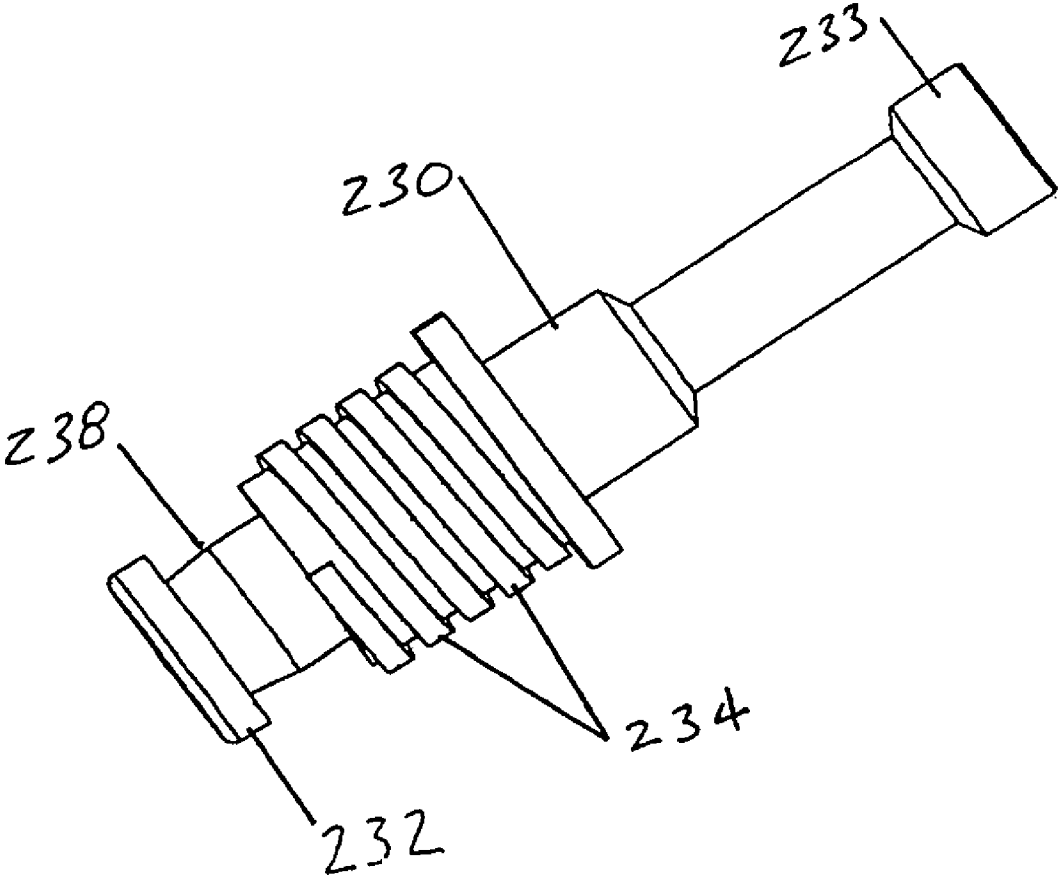
FIG. 40 is a side view of a gas escape valve for use therewith.

As noted above, a plurality of high pressure refrigerant cylinders 220 may be inserted into bottle 200 through neck 206. FIG. 32 illustrates a configuration wherein three cylinders, referenced as 220*a*, 220*b*, and 220*c*, are disposed within bottle 200. A retaining insert 250 is placed within the neck 206 of bottle 200. As best seen in FIG. 38, retaining insert 250 comprises a generally hollow, open ended body having a generally cylindrical wall 252 having a plurality of longitudinally aligned smaller cylindrical wall structures, referenced as 254, defined in peripheral proximity to wall 252. Cylindrical wall structures 254 are sized for receiving a projecting tubular end member 248 projecting from cap 240 when operatively installed in a bottle 200 as depicted in FIGS. 32 and 33.

In accordance with this embodiment, cryogenic cylinders 220 function to chill the beverage (or other food product) within container 200 as follows. First three cylinders 220*a*, 220*b*, and 220*c*, are charged with refrigerant. As noted above, any suitable cylinder number is considered within the scope of the present invention. In a preferred embodiment, the refrigerant comprises compressed $CO_2$. The pressure within each cylinder is referred to as $P_{ref}$. Cylinders 220 are preferably pre-charged with compressed gas and assembled with metering device 230 and cap 240 installed in operative engagement. In that regard, it is noted that cap 240 is configurable from a first configuration wherein cap 240 is disposed in a longitudinally compact configuration whereby the projecting end of capillary tube 239 is sealingly received within cylindrical recess 247 so as to prevent the compressed gas from prematurely escaping. As should be apparent, cap 240 is capable of being configured in a longitudinally expanded configuration wherein the end of capillary tube 239 is uncovered thereby placing the compressed gas contents of cylinder 222 in fluid communication with the surrounding atmosphere via the interior of cap 240 and tubular member 248 via axial opening 249 as shown in FIG. 37.

Once inserted within bottle 200, pre-charged cylinders are secured therein by insertion of retaining insert 250 within neck 206 of bottle 200. More particularly, axially projecting tubular member 248 of each cylinder cap 240 is received within cylindrical wall structures 254 of retaining insert 250 such that each cylinder cap 240 is capable of axial movement from the longitudinally compact configuration shown in FIG. 36 to the longitudinally expanded configuration shown in FIG. 37. Cap 240 is initially maintained in the longitudinally compact configuration by press fit engagement between cap 240 and metering device 230 due in part to the relatively small surface area of cap 240 exposed to $P_{ref}$ (pressure of the compressed gas) via capillary tube 239 received within recess 245.

The cryogenic apparatus is then charged to an activatable state when carbonated beverage is placed in bottle 200 and cap 210 is affixed thereby placing the contents of the container under a positive pressure (e.g. above atmospheric pressure). More particularly, the positive pressure within the container, referred to herein as $P_{bev}$, dislodges sealing member 246 to allow gas at $P_{bev}$ to enter cap 240 via aperture 244 thereby placing the internal volume bounded by cap 240 to a pressure equal to $P_{bev}$ (e.g. above atmospheric) while the cap remains in the longitudinally compact configuration.

Once bottle 200 is opened by the user pressure is released and the pressure within the bottle drops from Pbev to atmospheric ($P_A$). As a result, the elevated $P_{bev}$ pressure within cap 240 forces cap 240 into the longitudinally expanded configuration shown in FIG. 37 thereby allowing compressed gas (or liquid) to expand and escape to the atmosphere from cylinder 222 via metering device 230 (and/or capillary tube 239 if used) and tubular member 248 via axial opening 249 as shown in FIG. 37. Meanwhile cap 240 is retained within bottle 200 by retaining insert 250. The expanding gas results in a temperature drop within cylinder 222 that allows for heat to be absorbed from the contents of the container thereby chilling the contents.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A self-cooling beverage container comprising:

a container body having a top and a bottom, a side wall connecting said top and bottom, said top including an openable portion;

at least one pressure vessel substantially housed within said container body, said pressure vessel containing a refrigerant under pressure;

means for retaining said pressure vessel within said container body;

a refrigerant metering device having an inlet in fluid communication with said refrigerant, and an outlet;

an actuation valve configurable from a closed configuration wherein said metering device outlet is closed, to an open configuration wherein said metering device outlet is open and exposed to the pressure within the container body;

said actuation valve including means for equalizing pressure within said actuation valve to pressure within said container body;

said actuation valve maintained in said closed configuration when pressure within said container body is greater than atmospheric pressure; and said actuation valve being automatically configured to said open configuration by pressure therein upon opening of said container body open portion and reduction of pressure within said container body to substantially atmospheric pressure;

whereby said actuation valve open configuration allows for refrigerant expansion and flow through said outlet conduit thereby cooling contents of said container.

2. A self-cooling beverage container according to claim 1, wherein said actuation valve includes a includes a check valve.

3. A self-cooling beverage container according to claim 2, wherein said check valve comprises an opening in said actuation valve leading to an internal chamber, said chamber including means for allowing expansion thereof when pressure within said internal chamber is greater than external pressure.

4. A self-cooling beverage container according to claim 1, wherein said refrigerant includes carbon dioxide.

5. A self-cooling beverage container comprising:

a container body having a top and a bottom, a side wall connecting said top and bottom, said top including an openable portion;

a plurality of pressure vessels substantially housed within said container body, each of said pressure vessels containing a refrigerant under pressure;

each pressure vessel including a refrigerant metering device having an inlet in fluid communication with refrigerant contained within the pressure vessel, and an outlet;

each pressure vessel including an actuation valve configurable from a closed configuration wherein flow through said metering device is prevented, to an open configuration wherein flow through said metering device outlet is allowed and refrigerant contained within said pressure vessel is placed in fluid communication with the interior of said container body;

each of said actuation valves each including means for equalizing pressure within said actuation valve to pressure within said container body;

each of said actuation valves maintained in said closed configuration when pressure within said container body is greater than atmospheric pressure; and each of said actuation valves being automatically configured to said open configuration by pressure therein upon opening of said container body open portion and reduction of pressure within said container body to substantially atmospheric pressure;

whereby said actuation valve open configuration allows for refrigerant expansion and flow through said outlet conduit thereby cooling contents of said container.

6. A self-cooling beverage container according to claim 5, wherein said actuation valve includes a includes a check valve.

7. A self-cooling beverage container according to claim 6, wherein said check valve comprises an opening in said actuation valve leading to an internal chamber, said chamber including means for allowing expansion thereof when pressure within said internal chamber is greater than external pressure.

8. A self-cooling beverage container according to claim 5, wherein said refrigerant includes carbon dioxide.

* * * * *